United States Patent [19]

Glanz et al.

[11] Patent Number: 4,870,047

[45] Date of Patent: Sep. 26, 1989

[54] THERMALLY-RESPONSIVE RECORD MATERIAL

[75] Inventors: Kenneth D. Glanz, Appleton; Gerald C. Bartman, New London, both of Wis.

[73] Assignee: Appleton Papers Inc., Appleton, Wis.

[21] Appl. No.: 239,493

[22] Filed: Sep. 1, 1988

[51] Int. Cl.[4] ..... B41M 5/18

[52] U.S. Cl. ..... 503/209; 427/150; 428/913; 503/208; 503/216; 503/217; 503/225

[58] Field of Search ..... 427/150–152; 428/913, 914; 503/208, 209, 216, 217, 225, 221, 223

[56] References Cited

U.S. PATENT DOCUMENTS

| | | | |
|---|---|---|---|
| 4,470,057 | 9/1984 | Glanz | 503/209 |
| 4,791,096 | 12/1988 | Mise | 503/216 |

FOREIGN PATENT DOCUMENTS

| | | | |
|---|---|---|---|
| 3602437 A1 | 7/1986 | Fed. Rep. of Germany | 503/209 |
| 60-101171 | 11/1983 | Japan | 503/209 |
| 63-178077 | 7/1988 | Japan | 503/209 |
| 63-178078 | 7/1988 | Japan | 503/209 |

*Primary Examiner*—Bruce H. Hess
*Attorney, Agent, or Firm*—Benjamin Mieliulis

[57] ABSTRACT

A novel thermally-responsive record material is disclosed which is resistant to image fade from one or more common external challenges including contact with common fats or oils, skin oil, carbonless solvents, plasticizers or high heat and humidity, such as in a 90°F./90% humidity test. The heat-sensitive material of the invention contains a fade resistance imparting ascorbic acid ester of the formula

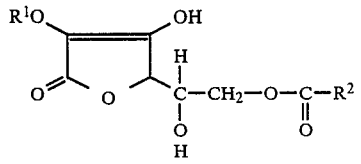

where $R^1$ is hydrogen or a straight chain or branched chain acyl group of from 9 to 22 carbons inclusive, wherein $R^2$ is a straight chain or branched chain alkyl group of from 8 to 21 carbons inclusive.

16 Claims, No Drawings

THERMALLY-RESPONSIVE RECORD MATERIAL

BACKGROUND OF THE INVENTION

1. Field of Invention

This invention relates to thermally-responsive record material. It more particularly relates to such record material in the form of sheets coated with color-forming systems comprising chromogenic material, and acidic color developer. This invention particularly concerns a thermally-responsive record material capable of forming an image resistant to fade or erasure. The invention teaches a record material having improved image density retention.

2. Description of Related Art

Thermally-responsive record material systems are well known in the art and are described in many patents, for example, U.S. Pat. Nos. 3,539,375; 3,674,535; 3,746,675; 4,151,748; 4,181,771; 4,246,318; and 4,470,057 which are incorporated herein by reference. In these systems, basic chromogenic material and acidic color developer material are contained in a coating on a substrate which, when heated to a suitable temperature, melts or softens to permit said materials to react, thereby producing a colored mark.

Thermally-responsive record materials have characteristic thermal responses, desirably producing a colored image of sufficient intensity upon selective thermal exposure.

A drawback of thermally-responsive record materials limiting utilization in certain environments and applications has been the undesirable tendency of thermally-responsive record materials upon forming an image to not retain that image in its original integrity over time when the thermally-responsive record material is handled or exposed to common liquids or oils or plasticizers such as found in skin oil, plastic food wrap, cooking oil and common carbonless paper solvents. As a result, a high degree of care and control in handling imaged thermally-responsive record materials has been required. This loss of image density and fade can be not only annoying but potentially damaging commercially whenever the integrity of records is allowed to become suspect through improper record storage.

To impart ability to a thermally-responsive record material to resist image fading or erasure upon contact with common oils, solvents or plasticizers would be an advance in the art and of commercial significance.

It is an object of the present invention to disclose a thermally-responsive record material having improved image retention and resistance to fade or erasure. The record material of the invention is remarkably resistant to fade or erasure from one or more common external challenges including contact with saponified fats or common oils, skin oil, internal phase (IP) solvents (carbonless solvents), plasticizers, or high heat and humidity such as in a 90° F./90% humidity test chamber.

It is an object of the present invention to disclose a thermally-responsive record material comprising a support member bearing a thermally-sensitive color forming composition comprising chromogenic material and acidic developer material in substantially contiguous relationship, whereby the melting, softening or sublimation of either material produces a change in color by reaction between the two, an ascorbic acid ester, optionally but preferably a modifier and a suitable binder therefor.

SUMMARY OF THE INVENTION

The present invention is an improved thermally-responsive record material having improved image retention. The invention is an improved heat-sensitive record material, typically a sheet material, bearing a thermally-responsive color-forming composition comprising a chromogenic material, an acidic developer material, and an ascorbic acid ester. The ascorbic acid esters being of the general formula:

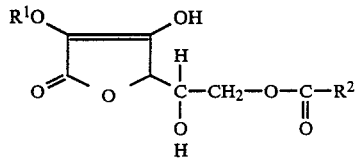

(I)

wherein $R^1$ is hydrogen or a straight chai or branched chain acyl group of from 9 to 22 carbons inclusive, wherein $R^2$ is a straight chain or branched chain alkyl group of from 8 to 21 carbons inclusive.

Preferably $R^1$ is hydrogen and preferably $R^2$ is $C_{15}H_{31}$ or $C_{17}H_{33}$ alkyl groups.

The term "acyl" as used herein is to be understood as referring to and encompassing carbonyl groups having attached thereto a straight chain or branched chain alkyl group, more particularly "acyl" encompasses the following

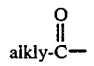

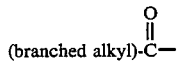

wherein the alkyl groups are straight chain or branched chains of from 8–21 carbons inclusive.

The ascorbic acid ester ca be the acidic developer material but preferably the acidic developer material is selected from any commonly utilized in the heat-sensitive paper industry. Acidic developers (also known as coreactants) include phenol reactive materials and include coreactants such as 2,2-bis(4-hydroxylphenyl)-4-methylpentane, 4,4'-isopropylidinediphenol, bis(3-allyl-4-hydroxyphenyl)sulfone, benzyl-p-hydroxybenzoate, 1,1-bis(4-hydroxyphenol)cyclohexane, allyl-4,4-bis(4-hydroxyphenyl)pentanoate; and 4,4'-[1,3-phenylenebis(1-methyl-ethylidene]bisphenol. The acidic developer materials help promote image formation and differ from modifiers or sensitizers, as the acidic developer materials by reaction impart image intensity.

The addition of the ascobic acid ester according to Formula I ("ascorbic acid ester") and preferably in combination with any of the commonly used acidic developer materials was found to surprisingly impart to imaged thermal papers unexpected resistance to fade and image erasure as compared to papers omitting the ascorbic acid ester.

The thermally-responsive record material of the invention has the unexpected and remarkable properties of being capable of forming a high densty image upon selective thermal contact and of retaining that image over time when handled or exposed to common skin oils, internal phase solvents (carbonless solvents), plasticizers, or high heat and humidity such as in a 90° F./90% humidity test chamber. This remarkable ability to impart fade and erasure resistance to thermally-responsive record materials is a significant advance in the art.

DETAILED DESCRIPTION

Description of Preferred Embodiments

The present invention is a novel thermally-responsive record material bearing a thermally-sensitive color-forming composition comprising a chromogenic material and an acidic developer material in substantially contiguous relationship, whereby the melting, softening or sublimation of either material produces a change in color reaction and an ascorbic acid ester which is selected from ascobic acid esters of the general formula:

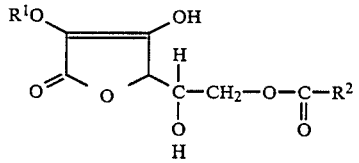

wherein $R^1$ is hydrogen or a straight chain or branched chain acyl group of from 9 to 22 carbons inclusive wherein $R^2$ is a straight chain or branched chain alkyl group of from 8 to 21 carbons inclusive.

Preferably $R^2$ is a saturated $C_{15}H_{31}$ or $C_{17}H_{33}$ alkyl group, and $R^1$ preferably is hydrogen.

The term "acyl" as used is to be understood as referring to and encompassing carbonyl groups having attached thereto a straight chain or branched chain alkyl group, more particularly "acyl" encompasses the following

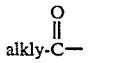

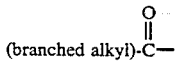

wherein the alkyl groups are straight chain or branched chain of from 8–21 carbons inclusive.

The ascorbic acid esters of the invention include, by way of illustration, the D or L, or racemates of ascorbic acid-6-stearate, ascorbic acid-2,6-dipalmitate, ascorbic acid-6-laurate, iso ascorbic acid-6-laurate, or iso ascorbic acid-6-palmitate.

The acidic developer material is most often and preferably a phenolic material. These acid developer materials include by way of illustration and not limitatively materials such as 2,2-bis(4-hydroxyphenyl)-4-methylpentane, 4,4'-isopropylidinediphenol, bis(3-allyl-4-hydroxyphenyl)sulfone and benzyl-p-hydroxybenzoate. Example of eligible acidic developer materials, particularly the phenolic materials are set forth in more detail later herein.

The addition of ascorbic acid ester according to Formula I to any of the commonly used acidic developer material was found to impart to imaged thermal papers unexpected resistance to fade and image erasure, attributable to solvent and oil contact, as compared to such papers omitting the ascorbic acid ester according to Formula I.

Isomeric form was found not to diminish image retentiveness. No case was identified wherein the isomeric form did not function effectively, thus the isomeric form did not appear itself determinative of effectiveness as compared to the racemates. Both the D and L forms of the ascorbic acid esters of the invention were functional.

Optionally, but preferably a modifier (also known as a sensitizer) such as a 1,2-diphenoxyethane is included. Such material typically does not impart any image on its own but as a relatively low melting solid acts as a solvent to facilitate reaction between the mark-forming components. Other such modifiers are described in U.S. Pat. No. 4,531,140. Other modifiers for example can include acetoacet-o-toluidine, phenyl-1-hydroxy-2-naphthoate, dibenzyloxalate, and para-benzylbiphenyl.

The color-forming composition (or system) of the record material of this invention comprises chromogenic material in its substantially colorless state and acidic developer material such as, for example, phenolic compounds. The ascorbic acid ester may itself be the developer material but its use in combination with other developers is more desirable. The color-forming system typically relies upon melting, softening, or subliming one or more of the components to achieve reactive, color-producing contact.

The record material includes a substrate or support material which is generally in sheet form. For purposes of this invention, sheets can be referred to as support members and are understood to also mean webs, ribbons, tapes, belts, films, cards and the like. Sheets denote articles having two large surface dimensions and a comparatively small thickness dimension. The substrate or support material can be opaque, transparent or translucent and could, itself, be colored or not. The material can be fibrous including, for example, paper and filamentous synthetic materials. It can be a film including, for example, cellophane and synthetic polymeric sheets cast, extruded, or otherwise formed. Invention resides in the color-forming composition coated on the substrate. The kind or type of substrate material is not critical.

The components of the color-forming system are in a proximate relationship meaning, a substantially contiguous or near contiguous relationship, substantially homogeneously distributed throughout the coated layer material deposited on the substrate. In manufacturing the record material, a coating composition is prepared which includes a fine dispersion of the components of the color-forming system, binder material typically a polymeric material, surface active agents and other additives in an aqueous coating medium. The composition can additionally contain inert pigments, such as clay, talc, aluminum hyroxide, calcined kaolin clay and calcium carbonate; synthetic pigments, such as urea-formaldehyde resin pigments; natural waxes such as Carnuba wax; synthetic waxes; lubricants such as zinc stearate; wetting agents; defoamers, and antioxidants.

The color-forming system components are substantially insoluble in the dispesion vehicle (preferably water) and are ground to an individual average particle size of between about 1 micron to about 10 microns, preferably about 1–3 microns. A binder can be included. The binder can be a polymeric material and is substantially vehicle soluble although latexes are also eligible in some instances. Preferred water soluble binders include polyvinyl alcohol, hydroxy ethylcellulose, methylcellulose, methyl-hydroxypropylcellulose, starch, styrene maleic anhydride salts, modified starches, gelatin and the like. Eligible latex materials include polyacrylates, styrene-butadiene-rubber latexes, polyvinylacetates, polystyrene, and the like. The polymeric binder is used to protect the coated materials from brushing and handling forces occasioned by storage and use of thermal sheets. Binder should be present in an amount to afford such protection and in an amount less than will interfere with achieving reactive contact between color-forming reactive materials.

Coating weights can effectively be about 3 to about 9 grams per square meter (gsm) and preferably about 5 to about 6 gms. The practical amount of color-forming materials is controlled by economic considerations, functional parameters and desired handling characteristics of the coated sheets.

Eligible chromogenic compounds, such as the phthalide, leucauramine and fluoran compounds, for use in the color-foring system are well known color-forming compounds. Examples of the compounds include Crystal Violet Lactone (3,3-bis(4-dimethylaminophenyl)-6-dimethylaminophthalide, U.S. Pat. No. Re. 23,024); phenyl-, indol-, pyrrol-, and carbazol-substituted phthalides (for example, in U.S. Pat. Nos. 3,491,111; 3,491,112; 3,491,116; 3,509,174); nitro-, amino-, amido-, sulfonamido-, aminobenzylidene-, halo-, anilino-substituted fluorans (for example, in U.S. Pat. Nos. 3,624,107; 3,627,787; 3,641,011; 3,642,828; 3,681,390); spirodipyrans (U.S. Pat. No. 3,971,808); and pyridine and pyrazine compounds (for example, in U.S. Pat. Nos. 3,775,424 and 3,853,869). Other specifically eligible chromogenic compounds, not limiting the invention in any way, are: 3-diethylamino-6-methyl-7-anilino-fluoran (U.S. Pat. No. 3,681,390); 2-anilino-3-methyl-6-dibutylamino-fluoran (U.S. Pat. No. 4,510,513) also known as 3-dibutylamino-6-methyl-7-anilino-fluoran; 3-dibutylamino-7-(2-chloroanilino)fluoran; 3-(N-ethyl-N-tetrahydrofurfurylamino)-6-methyl-7-3,5'6-tris(dimethylamino)spiro[9H-fluorene-9,1'(3'H)-isobenzofuran]-3'-one; 7-(1-ethyl-2-methylindol-3-yl)-7-(4-diethylamino-2-ethoxyphenyl)-5,7-dihydrofuro[3,4-b]pyridin-5-one (U.S. Pat. No. 4,246,318); 3-diethylamino-7-(2-chloroanilino)fluoran (U.S. Pat. No. 3,920,510); 3-(N-methylcyclohexylamino)-6-methyl-7-anilinofluoran (U.S. Pat. No. 3,959,571); 7-(1-octyl-2-methylindol-3-yl)-7-(4-diethylamino-2-ethoxyphenyl)-5,7-dihydrofuro[3,4-b]pyridin-5-one; 3-diethylamino-7,8-benzofluoran; 3,3-bis(1-ethyl-2-methylindol-3-yl)phthalide; 3-diethylamino-7-anilinofluoran; 3-diethylamino-7-benzylaminofluoran; 3'-phenyl-7-dibenzylamino-2,2'-spiro-di-[2H-1-benzopyran] and mixtures of any of the following.

Examples of eligible acidic developer material include the compounds listed in U.S. Pat. No. 3,539,375 as phenolic reactive material, particularly the monophenols and diphenols. Eligible acidic developer material also includes, without being considered as limiting, the following compounds which may be used individually or in mixtures: 4,4'-isopropylidinediphenol (Bisphenol A); p-hydroxybenzaldehyde; p-hydroxybenzophenone; p-hydroxypropiophenone; 2,4-dihydroxybenzophenone; 1,1-bis(4-hydroxyphenyl)cyclohexane; salicyanilide; 4-hydroxy-2-methylacetophenone; 2-acetylbenzoic acid; m-hydroxyacetanilide; p-hydroxyacetanilide; 2,4-dihydroxyacetophenone; 4-hydroxy-4'-methylbenzophenone; 4,4'-dihydroxybenzophenone; bis(3-allyl-4-hydroxyphenyl)sulfone, 2,2-bis(4-hydroxyphenyl)-4-methylpentane; benzyl 4-hydroxyphenyl ketone; 2,2-bis(4-hydoxyphenyl)-5-methylhexane; ethyl-4,4-bis(4-hydroxyphenyl)-pentanoate; isopropyl-4,4-bis(4-hydroxyphenyl)pentanoate; methyl-4,4-bis(4-hydroxyphenyl)pentanoate; allyl-4,4-bis(4-hydroxyphenyl)pentanoate; 3,3-bis(4-hydroxyphenyl)-pentane; 4,4-bis(4-hydroxphenyl)-heptane; 2,2-bis(4-hydroxyphenyl)-1-phenylpropane; 2,2-bis(4-hydroxyphenyl)butane; 2,2'-methylene-bis(4-ethyl-6-tertiarybutyl phenol); 4-hydroxycoumarin; 7-hydroxy-4-methylcoumarin; 2,2'-methylene-bis(4-octyl phenol); 4,4'-sulfonyldiphenol; 4,4'-thiobis(6-tertiarybutyl-m-cresol); methyl-p-hydroxybenzoate; n-propyl-p-hydroxybenzoate; benzyl-p-hydroxybenzoate; 4-(4-(1-methylethoxy)phenyl sulphonyl phenol. Preferred among these are the phenolic developer compounds. More preferred among the phenol compounds are 4,4'-isopropylindinediphenol, ethyl-4,4-bis(4-hydroxyphenyl)-pentanoate, n-propyl-4,4-bis(4-hydroxyphenyl)pentanoate, isopropyl-4,4-bis(4-hydroxyphenyl)pentanoate, methyl-4,4-bis(4-hydroxyphenyl)pentanoate, 2,2-bis(4-hydroxyphenyl)-4-methylpentane, p-hydroxybenzophenone, 2,4-dihydroxybenzophenone, 1,1-bis(4-hydroxyphenyl)cyclohexane, and benzyl-p-hydroxybenzoate; 4-(4-(1-methylethoxy)phenyl) sulphonyl phenol and 4,4'-[1,3-phenylenebis(1-methylethylene]bisphenol. Acid compounds of other kind and types are eligible. Examples of such other compounds are phenolic novolak resins which are the product of reaction between, for example, formaldehyde and a phenol such as an alkylphenol, e.g., p-octylphenol, or other phenols such as p-phenylphenol, and the like; and acid mineral materials including colloidal silica, kaolin, bentonite, attapulgite, hallosyte, and the like. Some of the polymers and minerals do not melt but undergo color reaction on fusion of the chromogen. Of the foregoing particularly the phenol type of compounds are more preferable acidic developer materials.

The following examples are given to illustrate some of the features of the present invention and should not be considered as limiting. In these examples all parts or proportions are by weight and all measurements are in the metric system, unless otherwise stated.

In all examples illustrating the present invention a dispersion of a particular system component was prepared by milling the component in an aqueous solution of the binder until a particle size of between about 1 micron and 10 microns was achieved. The milling was accomplished in an attritor or other suitable milling device. The desired average particle size was about 1–3 microns in each dispersion.

The thermally-responsive sheets were made by making separate dispersions of chromogenic material, acidic material and ascobic acid esters. The dispersions were mixed in the desired ratios and applied to a support with a wire wound rod and dried. Other materials such as modifiers, fillers, antioxidants, lubricants and waxes can be added if desired. The sheets may be calendered to improve smoothness.

In the examples the thermal response of the sheets was checked by imaging with a laboratory printer, Table 1, or a Group III facsimile machine, Table 2. Facsimile machines used included HIFAX 700, SHARP FO-210, and CANON FAX-230. The color produced was measured with a Macbeth RD514 densitometer, #106 filter.

The resistance to image erasure was checked by placing a fingerprint rich in skin oil on the imaged area. The area is observed and any changes in image quality are noted. The same observations are made using the plastic film, Borden Resenite RMF-61HY. A piece of film larger than the imaged area is placed on the sample and weighted with a flat surface. Cooking oil (liquid Crisco) and IP solvent (carbonless solvent for example, a blend of Suresol 290 and Norpar 13), are tested by saturating the image using a cotton swab, Table 3.

The ranking scale for image resistance in the observations for charges in image quality is 0–4.

0=No change in image quality.
1=Image density reduced but no erasure.
2=Image density reduced and slight erasure.
3=Moderate erasure of image.
4=Complete erasure of image.

The dispersions were prepared in a quickie mill, attritor and small media mill. (Nopco NDW is a sulfonated castor oil produced by Nopco Chemical Company. Surfynol 104 is a di-tertiary acetylene glycol surface active agent produced by Air Products and Chemicals, Inc.)

| | Parts |
|---|---|
| Dispersion A-1 - Chromogenic Material is N-102 3-diethylamino-6-methyl-7-anilinofluoran. | |
| N-102 | 94.95 |
| PVA, Vinoll 205 20% in Water | 81.00 |
| Nopco NDW | 0.23 |
| Surfynol 104 | 1.13 |
| Water | 122.69 |
| Dispersion A-2 - Chromogenic Material is Butyl N-102 3-dibutylamino-6-methyl-7-anilinofluoran. | |
| Butyl N-102 | 17.00 |
| PVA, Vinol 205 20% in Water | 14.50 |
| Nopco NDW | 0.08 |
| Surfynol 104 | 0.02 |
| Water | 68.40 |
| Dipersion A-3 - Chromogenic Material is PSD-150 3-(N—cyclohexyl-N—methylamino)-6-methyl-7-anilinofluoran. | |
| PSD-150 | 13.50 |
| PVA, Vinol 205, 20% | 11.40 |
| Nopco NDW | 0.10 |
| Surfynol 104 | 0.02 |
| Water | 54.98 |
| Dispersion A-4 - Chromogenic Material is CF-51 | |
| 3-(N—ethyl-N—tetrahydrofurfurylamino)-6-methyl-7-anilinofluoran. | |
| Dispersion prepared the same as A-3 but using CF-51. | |
| Dispersion A-5 - Chromogenic Material is S-205 | |
| 3-(N—ethyl-N—methylbutylamino)-6-methyl-7-anilinofluoran. | |
| Dispersion prepared the same as A-3 but using S-205 | |
| Dispersion A-6 - Chromogenic Material is SF-76-296 7-(N,N—dibenzylamino-3'isobutyl(*)2,2'spirobi 2H—l-benzopyran. | |
| SF-76-296 | 9.0 |
| PVA, Vinol 325, 10% | 24.0 |
| Nopco NDW | 0.01 |
| Surfynol 104 | 0.04 |
| Water | 42.4 |
| Dispersion A-7 - Chromogenic Material is TECVIL 3,3-bis(4-diethylaminophenyl)-6-dimethylaminophthalide. | |
| Tecvil | 53.10 |
| PVA, Vinol 205, 10% | 90.00 |
| Nopco NDW | 0.10 |
| Surfynol 104 | 0.30 |
| Water | 106.10 |
| Dispersion A-8 - Chromogenic Material is PB-6 7-(l-ethyl-2-methylindol-3-yl)-7-(4,dimethylamino-2-ethoxy-phenyl)5,7-dihydrofuro,[3,4-b]pyridine-5-one. | |
| PB-6 | 17.00 |
| PVA, Vinol 205, 20% | 14.50 |
| Nopco NDW | 0.02 |
| Surfynol 104 | 0.08 |
| Water | 48.40 |
| Dispersion A-9 - Chromogenic Material is TH-107 | |
| 3-dibutylamino-7-(2-chloroanilino)fluoran. | |
| Dispersion prepared the same as A-8 but using TH-107 | |
| Dispersion B-1 - Acidic Material is AP-5 | |

-continued

| | Parts |
|---|---|
| 2,2-bis(4-hydroxyphenyl)-4-methylpentane. | |
| AP-5 | 102.00 |
| PVA, Vinol 205 20% in Water | 87.00 |
| Nopco NDW | 0.12 |
| Surfynol 104 | 0.48 |
| Water | 153.26 |
| Dispersion B-2 - Acidic Material is Bisphenol-A 4,4'isopropylidinediphenol. | |
| Bisphenol-A | 29.92 |
| PVA, Vinol 205 20% in Water | 25.52 |
| Nopco NDW | 0.14 |
| Surfynol 104 | 0.04 |
| Water | 44.95 |
| Dispersion B-3 - Acidic Material is A-Palm L-Ascorbic acid-6-palmitate. | |
| A-Palm | 17.00 |
| PVA, Vinol 205 20% in Water | 14.50 |
| Nopco NDW | 0.02 |
| Surfynol 104 | 0.08 |
| Water | 68.40 |
| Dispersion B-4 - Acidic Material is TG-S | |
| Bis(3-allyl-4-hydroxyphenyl)sulfone. | |
| Dispersion prepared the same as B-3 but using TG-S. | |
| Dispersion B-5 -Acidic Material is Bz | |
| Benzyl-p-hydroxybenzoate. | |
| Dispersion prepared the same as B-3 but using Bz. | |
| Dispersion B-6 - Acidic Material is Bis Z 1,1-Bis(4-hydroxyphenol)cyclohexane. | |
| Bis Z | 17.00 |
| PVA, Vinol 205, 20% | 14.50 |
| Nopco NDW | 0.02 |
| Surfynol 104 | 0.08 |
| Water | 68.40 |
| Dispersion B-7 - Acidic Material is Allyl ester Allyl-4,4-bis(4-hydroxyphenyl)pentanoate. | |
| Allyl ester | 85.00 |
| PVA, Vinol 205, 20% | 72.50 |
| Nopco NDW | 0.40 |
| Surfynol 104 | 0.10 |
| Water | 127.71 |
| Dispersion B-8 - Acidic Material is Bisphenol M 4,4'-[1,3-phenylenebis(1-methylethylidene)]bisphenol. | |
| Bisphenol M | 68.00 |
| PVA, Vinol 325 20% | 58.00 |
| Nopco NDW | 0.32 |
| Surfynol 104 | 0.08 |
| Water | 102.17 |
| Dispersion B-9 - Acidic Material is A-Stear L-Ascorbic Acid-6-Stearate. | |
| A-Stear | 17.00 |
| PVA, Vinol 205 20% in Water | 14.50 |
| Nopco NDW | 0.02 |
| Surfynol 104 | 0.08 |
| Water | 68.40 |
| Dispersion B-10 - Acidic Material is A-DiPalm L-Ascorbic Acid-2,6-Dipalmitate | |
| A-DiPalm | 17.00 |
| PVA, Vinol 205 20% in water | 14.50 |
| Nopco NDW | 0.02 |
| Surfynol 104 | 0.08 |
| Water | 68.40 |
| Dispersion B-11 - Acidic Material is A-Laur L-Ascorbic Acid-6-Laurate. | |
| A-Laur | 4.93 |
| PVA, Vinol 205 20% | 4.21 |
| Nopco NDW | 0.01 |
| Surfynol 104 | 0.02 |
| Water | 48.83 |
| Dispersion B-12 - Acidic Material is Iso A-Laur D-Iso Ascorbic Acid-6-Laurate. | |
| Iso A-Laur | 5.95 |
| PVA, Vinol 205, 20% | 5.08 |
| Nopco NDW | 0.01 |
| Surfynol 104 | 0.03 |
| Water | 58.93 |
| Dispersion B-13 - Acidic Material is D-8 4(4-(1-Methylethoxy)phenyl)Sulphonyl phenol | |

-continued

| | Parts |
|---|---|
| D-8 | 13.60 |
| PVA, Vinol 205 20% in Water | 11.60 |
| Nopco NDW | 0.06 |
| Surfynol 104 | 0.02 |
| Water | 54.72 |
| Dispersion B-14 - Acidic Material is Iso A-Palm D-Iso Ascorbic acid-6-Palmitate | |
| Iso A-Palm | 5.80 |
| PVA, Vinol 205 20% | 4.95 |
| Nopco NDW | 0.01 |
| Surfynol 104 | 0.03 |
| $H_2O$ | 57.45 |
| Dispersion C-1 - Sensitizer is DPE 1,2-diphenoxyethane. | |
| DPE | 89.25 |
| PVA, Vinol 205 20% in Water | 76.13 |
| Nopco NDW | 0.11 |
| Surfynol 104 | 0.42 |
| Water | 134.09 |
| Dispersion C-2 - Sensitizer is Stearamide | |
| Commercial material Hidorin B-934, 20% solids, Nagase America Corp. | |
| Dispersion C-3 - Sensitizer is AAOT Acetoacet-o-tolueidine. | |
| AAOT | 79.90 |
| PVA, Vinol 205, 20% | 68.15 |
| Nopco NDW | 0.09 |
| Surfynol 104 | 0.38 |
| Water | 51.48 |
| Dispersion C-4 - Sensitizer is BBP para-benzylbiphenyl. | |
| BBP | 85.00 |
| PVA, Vinol 205, 20% | 72.50 |
| Nopco NDW | 0.40 |
| Surfynol 104 | 0.10 |
| Water | 127.71 |
| Dispersion C-5 - Sensitizer is PHNT phenyl-1-hydroxy-2-naphthoate. | |
| PHNT | 85.00 |
| PVA, Vinol 205, 20% | 72.50 |
| Nopco NDW | 0.40 |
| Surfynol 104 | 0.10 |
| Water | 127.71 |

Test Formulation

| | Material | Parts |
|---|---|---|
| Control-1 | Dispersion A-1 (N-102) | 0.75 |
| | Dispersion B-1 (AP-5) | 5.38 |
| | Filler | 1.12 |
| | PVA, Vinol 325, 10% | 4.87 |
| | Zinc Stearate, 23.3% | 1.03 |
| | Water | 6.85 |
| Example-1-1 | Dispersion A-1 (N-102) | 0.75 |
| | Dispersion B-3 (A-Palm) | 9.41 |
| | Filler | 1.12 |
| | PVA, Vinol 325, 10% | 4.87 |
| | Zinc Stearate, 23.3% | 1.03 |
| | Water | 2.82 |
| Example-1-2 | Dispersion A-1 (N-102) | 0.75 |
| | Dispersion B-1 (AP-5) | 2.69 |
| | Dispersion B-3 (A-Palm) | 4.71 |
| | Filler | 1.12 |
| | PVA, Invol 325, 10% | 4.87 |
| | Zinc Stearate, 23.3% | 1.03 |
| | Water | 4.83 |
| Example-1-3 | Dispersion A-1 (N-102) | 0.75 |
| | Dispersion B-9 (A-Stear) | 9.41 |
| | Filler | 1.12 |
| | PVA, Vinol 325, 10% | 4.87 |
| | Zinc Stearate, 23.3% | 1.03 |
| | Water | 2.82 |
| Example-1-4 | Dispersion A-1 (N-102) | 0.75 |
| | Dispersion B-1 (AP-5) | 2.69 |
| | Dispersion B-9 (A-Stear) | 4.71 |
| | Filler | 1.12 |

-continued

Test Formulation

| | Material | Parts |
|---|---|---|
| | PVA, Vinol 325, 10% | 4.87 |
| | Zinc Stearate, 23.3% | 1.03 |
| | Water | 4.83 |
| Example-1-5 | Dispersion A-1 (N-102) | 0.75 |
| | Dispersion B-10 (A-Dipalm) | 9.41 |
| | Filler | 1.12 |
| | PVA, Vinol 325, 10% | 4.87 |
| | Zinc Stearate, 23.3% | 1.03 |
| | Water | 2.82 |
| Example-1-6 | Dispersion A-1 (N-102) | 0.75 |
| | Dispersion B-1 (AP-5) | 2.69 |
| | Dispersion B-10 (A-Dipalm) | 4.71 |
| | Filler | 1.12 |
| | PVA, Vinol 325, 10% | 4.87 |
| | Zinc Stearate, 23.3% | 1.03 |
| | Water | 4.83 |
| Example-1-7 | Dispersion A-1 (N-102) | 0.75 |
| | Dispersion B-11 (A-Laur) | 9.41 |
| | Filler | 1.12 |
| | PVA, Vinol 325, 10% | 4.87 |
| | Zinc Stearate, 23.3% | 1.03 |
| | Water | 2.82 |
| Example-1-8 | Dispersion A-1 (N-102) | 0.75 |
| | Dispersion B-1 (AP-5) | 2.69 |
| | Dispersion B-11 (A-Laur) | 4.71 |
| | Filler | 1.12 |
| | PVA, Vinol 325, 10% | 4.87 |
| | Zinc Stearate, 23.3% | 1.03 |
| | Water | 4.83 |
| Example-1-9 | Dispersion A-1 (N-102) | 0.75 |
| | Dispersion B-12 (Iso A-Laur) | 9.41 |
| | Filler | 1.12 |
| | PVA, Vinol 325, 10% | 4.87 |
| | Zinc Stearate, 23.3% | 1.03 |
| | Water | 2.82 |
| Example-1-10 | Dispersion A-1 (N-102) | 0.75 |
| | Dispersion B-1 (AP-5) | 2.69 |
| | Dispersion B-12 (Iso A-Laur) | 4.71 |
| | Filler | 1.12 |
| | PVA, Vinol 325, 10% | 4.87 |
| | Zinc Stearate, 23.3% | 1.03 |
| | Water | 4.83 |
| Example-1-11 | Dispersion A-1 (N-102) | 0.56 |
| | Dispersion B-1 (AP-5) | 2.02 |
| | Dispersion B-14 (Iso A-Palm) | 7.06 |
| | Filler | 0.84 |
| | PVA, 325, 10% | 3.65 |
| | Zinc Stearate, 23.3% | 0.77 |
| | Water | 0.10 |
| Control-2 | Dispersion A-1 (N-102) | 0.75 |
| | Dispersion B-1 (AP-5) | 2.69 |
| | Dispersion C-1 (DPE) | 2.69 |
| | Filler | 1.12 |
| | PVA, Vinol 325, 10% | 4.87 |
| | Zinc Stearate, 23.3% | 1.03 |
| | Water | 6.85 |
| Example-2-1 | Dispersion A-1 (N-102) | 0.75 |
| | Dispersion B-3 (A-Palm) | 4.71 |
| | Dispersion C-1 (DPE) | 2.69 |
| | Filler | 1.12 |
| | PVA, Vinol 325, 10% | 4.87 |
| | Zinc Stearate, 23.3% | 1.03 |
| | Water | 4.83 |
| Example 2-2 | Dispersion A-1 (N-102) | 0.75 |
| | Dispersion B-1 (AP-5) | 1.34 |
| | Dispersion B-3 (A-Palm) | 2.35 |
| | Dispersion C-1 (DPE) | 2.69 |
| | Filler | 1.12 |
| | PVA, Vinol 325, 10% | 4.87 |
| | Zinc Stearate, 23.3% | 1.03 |
| | Water | 5.85 |
| Example 2-3 | Dispersion A-1 (N-102) | 0.75 |
| | Dispersion B-9 (A-Stear) | 4.71 |
| | Dispersion C-1 (DPE) | 2.69 |
| | Filler | 1.12 |
| | PVA, Vinol 325, 10% | 4.87 |
| | Zinc Stearate, 23.3% | 1.03 |
| | Water | 4.83 |
| Example 2-4 | Dispersion A-1 (N-102) | 0.75 |

-continued

| Test Formulation | | |
|---|---|---|
| | Material | Parts |
| | Dispersion B-1 (AP-5) | 1.35 |
| | Dispersion B-9 (A-Stear) | 2.35 |
| | Dispersion C-1 (DPE) | 2.69 |
| | Filler | 1.12 |
| | PVA, Vinol 325, 10% | 4.87 |
| | Zinc Stearate, 23.3% | 1.03 |
| | Water | 5.84 |
| Example-2-5 | Dispersion A-1 (N-102) | 0.75 |
| | Dispersion B-10 (A-Dipalm) | 4.71 |
| | Dispersion C-1 (DPE) | 2.69 |
| | Filler | 1.12 |
| | PVA, Vinol 325, 10% | 4.87 |
| | Zinc Stearate, 23.3% | 1.03 |
| | Water | 4.83 |
| Example-2-6 | Dispersion A-1 (N-102) | 0.75 |
| | Dispersion B-1 (AP-5) | 1.35 |
| | Dispersion B-10 (A-Dipalm) | 2.35 |
| | Dispersion C-1 (DPE) | 2.69 |
| | Filler | 1.12 |
| | PVA, Vinol 325, 10% | 4.87 |
| | Zinc Stearate, 23.3% | 1.03 |
| | Water | 5.84 |
| Example-2-7 | Dispersion A-1 (N-102) | 0.75 |
| | Dispersion B-11 (A-Laur) | 4.71 |
| | Dispersion C-1 (DPE) | 2.69 |
| | Filler | 1.12 |
| | PVA, Vinol 325, 10% | 4.87 |
| | Zinc Stearate, 23.3% | 1.03 |
| | Water | 4.83 |
| Example-2-8 | Dispersion A-1 (N-102) | 0.75 |
| | Dispersion B-1 (AP-5) | 1.35 |
| | Dispersion B-11 (A-Laur) | 2.35 |
| | Dispersion C-1 (DPE) | 2.69 |
| | Filler | 1.12 |
| | PVA, Vinol 325, 10% | 4.87 |
| | Zinc Stearate, 23.3% | 1.03 |
| | Water | 5.84 |
| Example-2-9 | Dispersion A-1 (N-102) | 0.75 |
| | Dispersion B-12 (Iso A-Laur) | 4.71 |
| | Dispersion C-1 (DPE) | 2.69 |
| | Filler | 1.12 |
| | PVA, Vinol 325, 10% | 4.87 |
| | Zinc Stearate, 23.3% | 1.03 |
| | Water | 4.83 |
| Example-2-10 | Dispersion A-1 (N-102) | 0.75 |
| | Dispersion B-1 (AP-5) | 1.35 |
| | Dispersion B-12 (Iso-A-Laur) | 2.35 |
| | Dispersion C-1 (DPE) | 2.69 |
| | Filler | 1.12 |
| | PVA, Vinol 325, 10% | 4.87 |
| | Zinc Stearate, 23.3% | 1.03 |
| | Water | 5.84 |
| Example-2-11 | Dispersion A-1 (N-102) | 0.56 |
| | Dispersion B-14 (Iso A-Palm) | 7.06 |
| | Dispersion C-1 (DPE) | 2.02 |
| | Filler | 0.84 |
| | PVA, 325, 10% | 3.65 |
| | Zinc Stearate, 23.3% | 0.77 |
| | Water | 0.10 |
| Example-2-12 | Dispersion A-1 (N-102) | 0.56 |
| | Dispersion B-1 (AP-5) | 1.01 |
| | Dispersion B-14 (Iso A-Palm) | 3.53 |
| | Dispersion C-1 (DPE) | 2.02 |
| | Filler | 0.84 |
| | PVA, 325, 10% | 3.65 |
| | Zinc Stearate, 23.3% | 0.77 |
| | Water | 2.62 |
| Control-3 | Dispersion A-1 (N-102) | 0.75 |
| | Dispersion B-1 (AP-5) | 2.69 |
| | Dispersion C-2 (Stearamide) | 4.00 |
| | Filler | 1.12 |
| | PVA, Vinol 325, 10% | 6.23 |
| | Zinc Stearate, 23.3% | 1.03 |
| | Water | 4.18 |
| Example-3-1 | Dispersion A-1 (N-102) | 0.75 |
| | Dispersion B-3 (A-Palm) | 4.71 |
| | Dispersion C-2 (Stearamide) | 4.00 |
| | Filler | 1.12 |
| | PVA, Vinol 325, 10% | 6.23 |

-continued

| Test Formulation | | |
|---|---|---|
| | Material | Parts |
| | Zinc Stearate, 23.3% | 1.03 |
| | Water | 2.16 |
| Example-3-2 | Dispersion A-1 (N-102) | 0.75 |
| | Dispersion B-1 (AP-5) | 1.34 |
| | Dispersion B-3 (A-Palm) | 2.35 |
| | Dispersion C-2 (Stearamide) | 4.00 |
| | Filler | 1.12 |
| | PVA, Vinol 325, 10% | 6.23 |
| | Zinc Stearate, 23.3% | 1.03 |
| | Water | 3.18 |
| Control-4 | Dispersion A-1 (N-102) | 0.75 |
| | Dispersion B-5 (Bz) | 4.71 |
| | Dispersion C-1 (DPE) | 2.69 |
| | Filler | 1.12 |
| | PVA, Vinol 325, 10% | 4.87 |
| | Zinc Stearate, 23.3% | 1.03 |
| | Water | 4.83 |
| Example-4-1 | Dispersion A-1 (N-102) | 0.75 |
| | Dispersion B-5 (Bz) | 2.35 |
| | Dispersion B-3 (A-Palm) | 2.35 |
| | Dispersion C-1 (DPE) | 2.69 |
| | Filler | 1.12 |
| | PVA, Vinol 325, 10% | 4.87 |
| | Zinc Stearate, 23.3% | 1.03 |
| | Water | 4.84 |
| Control-5 | Dispersion A-1 (N-102) | 0.75 |
| | Dispersion B-2 (Bisphenol-A) | 2.69 |
| | Dispersion C-1 (DPE) | 2.69 |
| | Filler | 1.12 |
| | PVA, Vinol 325, 10% | 4.87 |
| | Zinc Stearate, 23.3% | 1.03 |
| | Water | 6.85 |
| Example-5-1 | Dispersion A-1 (N-102) | 0.75 |
| | Dispersion B-2 (Bisphenol-A) | 1.34 |
| | Dispersion B-3 (A-Palm) | 1.35 |
| | Dispersion C-1 (DPE) | 2.69 |
| | Filler | 1.12 |
| | PVA, Vinol 325, 10% | 4.87 |
| | Zinc Stearate, 23.3% | 1.03 |
| | Water | 6.85 |
| Control-6 | Dispersion A-2 (Butyl N-102) | 1.41 |
| | dispersion B-4 (TG-S) | 4.71 |
| | Dispersion C-1 (DPE) | 2.69 |
| | Filler | 1.12 |
| | PVA, Vinol 325, 10% | 4.87 |
| | Zinc Stearate, 23.3% | 1.03 |
| | Water | 4.17 |
| Example-6-1 | Dispersion A-2 (Butyl N-102) | 1.41 |
| | Dispersion B-4 (TG-S) | 2.35 |
| | Dispersion B-3 (A-Palm) | 2.35 |
| | Dispersion C-1 (DPE) | 2.69 |
| | Filler | 1.12 |
| | PVA, Vinol 325, 10% | 4.87 |
| | Zinc Stearate, 23.3% | 1.03 |
| | Water | 4.18 |
| Control-7 | Dispersion A-1 (N-102) | 0.75 |
| | Dispersion B-6 (Bis Z) | 4.70 |
| | Dispersion C-1 (DPE) | 2.69 |
| | Filler | 1.12 |
| | PVA, Vinol 325, 10% | 4.87 |
| | Zinc Stearate, 23.3% | 1.03 |
| | Water | 4.84 |
| Example-7-1 | Dispersion A-1 (N-102) | 0.75 |
| | Dispersion B-3 (A-Palm) | 1.35 |
| | Disperion B-6 (Bis Z) | 2.35 |
| | Dispersion C-1 (DPE) | 2.69 |
| | Filler | 1.12 |
| | PVA, Vinol 325, 10% | 4.87 |
| | Zinc Stearate, 23.3% | 1.03 |
| | Water | 5.84 |
| Control-8 | Dispersion A-1 (N-102) | 0.75 |
| | Dispersion B-7 (Allyl ester) | 2.69 |
| | Dispersion C-1 (DPE) | 2.69 |
| | Filler | 1.12 |
| | PVA, Vinol 325, 10% | 4.87 |
| | Zinc Stearate, 23.3% | 1.03 |
| | Water | 6.85 |
| Example-8-1 | Dispersion A-1 (N-102) | 0.75 |
| | Dispersion B-7 (Allyl ester) | 1.35 |

-continued

| | Test Formulation Material | Parts |
|---|---|---|
| | Dispersion B-3 (A-Palm) | 1.35 |
| | Dispersion C-1 (DPE) | 2.69 |
| | Filler | 1.12 |
| | PVA, Vinol 325, 10% | 4.87 |
| | Zinc Stearate, 23.3% | 1.03 |
| | Water | 6.84 |
| Control-9 | Dispersion A-1 (N-102) | 0.75 |
| | Dispersion B-8 (Bis M) | 2.69 |
| | Dispersion C-1 (DPE) | 2.69 |
| | Filler | 1.12 |
| | PVA, Vinol 325, 10% | 4.87 |
| | Zinc Stearate, 23.3% | 1.03 |
| | Water | 6.85 |
| Example-9-1 | Dispersion A-1 (N-102) | 0.75 |
| | Dispersion B-8 (Bis M) | 1.35 |
| | Dispersion B-3 (A-Palm) | 1.35 |
| | Dispersion C-1 (DPE) | 2.69 |
| | Filler | 1.12 |
| | PVA, Vinol 325, 10% | 4.87 |
| | Zinc Stearate, 23.3% | 1.03 |
| | Water | 6.84 |
| Control-10 | Dispersion A-1 (N-102) | 0.75 |
| | Dispersion B-1 (AP-5) | 2.69 |
| | Dispersion C-3 (AAOT) | 2.00 |
| | Filler | 1.12 |
| | PVA, Vinol 325, 10% | 4.87 |
| | Zinc Stearate, 23.3% | 1.03 |
| | Water | 7.54 |
| Example-10-1 | Disperson A-1 (N-102) | 0.75 |
| | Dispersion B-3 (A-Palm) | 4.71 |
| | Dispersion C-3 (AAOT) | 2.00 |
| | Filler | 1.12 |
| | PVA, Vinol 325, 10% | 4.87 |
| | Zinc Stearate, 23.3% | 1.03 |
| | Water | 5.52 |
| Example-10-2 | Dispersion A-1 (N-102) | 0.75 |
| | Dispersion B-1 (AP-5) | 1.35 |
| | Dispersion B-3 (A-Palm) | 2.35 |
| | Dispersion C-3 (AAOT) | 2.00 |
| | Filler | 1.12 |
| | PVA, Vinol 325, 10% | 4.87 |
| | Zinc Stearate, 23.3% | 1.03 |
| | Water | 6.53 |
| Control-11 | Dispersion A-1 (N-102) | 0.75 |
| | Dispersion B-1 (AP-5) | 2.69 |
| | Dispersion C-4 (BBP) | 2.69 |
| | Filler | 1.12 |
| | PVA, Vinol 325, 10% | 4.87 |
| | Zinc Stearate, 23.3% | 1.03 |
| | Water | 6.85 |
| Example-11-1 | Dispersion A-1 (N-102) | 0.75 |
| | Dispersion B-3 (A-Palm) | 4.71 |
| | Dispersion C-4 (BBP) | 2.69 |
| | Filler | 1.12 |
| | PVA, Vinol 325, 10% | 4.87 |
| | Zinc Stearate, 23.3% | 1.03 |
| | Water | 4.83 |
| Example-11-2 | Dispersion A-1 (N-102) | 0.75 |
| | Dispersion B-1 (AP-5) | 1.35 |
| | Dispersion B-3 (A-Palm) | 2.35 |
| | Dispersion C-4 (BBP) | 2.69 |
| | Filler | 1.12 |
| | PVA, vinol 325, 10% | 4.87 |
| | Zinc Stearate, 23.3% | 1.03 |
| | Water | 5.84 |
| Control-12 | Dispersion A-1 (N-102) | 0.75 |
| | Dispersion B-1 (AP-5) | 2.69 |
| | Dispersion C-5 (PHNT) | 2.69 |
| | Filler | 1.12 |
| | PVA, Vinol 325, 10% | 4.87 |
| | Zinc Stearate, 23.3% | 1.03 |
| | Water | 6.85 |
| Example-12-1 | Dispersion A-1 (N-102) | 0.75 |
| | Dispersion B-3 (A-Palm) | 4.71 |
| | Dispersion C-5 (PHNT) | 2.69 |
| | Filler | 1.12 |
| | PVA, Vinol 325, 10% | 4.87 |
| | Zinc Stearate, 23.3% | 1.03 |
| | Water | 4.83 |

-continued

| | Test Formulation Material | Parts |
|---|---|---|
| Example-12-2 | Dispersion A-1 (N-102) | 0.75 |
| | Dispersion B-1 (AP-5) | 1.35 |
| | Dispersion B-3 (A-Palm) | 2.35 |
| | Dispersion C-5 (PHNT) | 2.69 |
| | Filler | 1.12 |
| | PVA, Vinol 325, 10% | 4.87 |
| | Zinc Stearate, 23.3% | 1.03 |
| | Water | 5.84 |
| Control-13 | Dispersion A-3 (PSD-150) | 1.41 |
| | Dispersion B-1 (AP-5) | 2.69 |
| | Dispersion C-1 (DPE) | 2.69 |
| | Filler | 1.12 |
| | PVA, Vinol 325, 10% | 4.87 |
| | Zinc Stearate, 23.3% | 1.03 |
| | Water | 6.19 |
| Example-13-1 | Dispersion A-3 (PSD-150) | 1.41 |
| | Dispersion B-1 (AP-5) | 1.35 |
| | Dispersion B-3 (A-Palm) | 2.35 |
| | Dispersion C-1 (DPE) | 2.69 |
| | Filler | 1.12 |
| | PVA, Vinol 325, 10% | 4.87 |
| | Zinc Stearate, 23.3% | 1.03 |
| | Water | 5.18 |
| Control-14 | Dispersion A-9 (TH-107) | 1.41 |
| | Dispersion B-1 (AP-5) | 2.69 |
| | Dispersion C-1 (DPE) | 2.69 |
| | Filler | 1.12 |
| | PVA, Vinol 325, 10% | 4.87 |
| | Zinc Stearate, 23.3% | 1.03 |
| | Water | 6.19 |
| Example-14-1 | Dispersion A-9 (TH-107) | 1.41 |
| | Dispersion B-1 (AP-5) | 1.35 |
| | Dispersion B-3 (A-Palm) | 2.35 |
| | Dispersion C-1 (DPE) | 2.69 |
| | Filler | 1.12 |
| | PVA, Vinol 325, 10% | 4.87 |
| | Zinc Stearate, 23.3% | 1.03 |
| | Water | 5.18 |
| Control-15 | Dispersion A-4 (CF-51) | 2.12 |
| | Dispersion B-1 (AP-5) | 4.03 |
| | Dispersion C-1 (DPE) | 4.03 |
| | Filler | 1.69 |
| | PVA, Vinol 325, 10% | 7.29 |
| | Zinc Stearate, 23.3% | 1.55 |
| | Water | 9.30 |
| Example 15-1 | Dispersion A-4 (CF-51) | 2.12 |
| | Dispersion B-1 (AP-5) | 2.02 |
| | Dispersion B-3 (A-Palm) | 3.53 |
| | Dispersion C-1 (DPE) | 4.03 |
| | Filler | 1.69 |
| | PVA, Vinol 325, 10% | 7.29 |
| | Zinc Stearate, 23.3% | 1.55 |
| | Water | 7.78 |
| Control-16 | Dispersion A-5 (S-205) | 2.12 |
| | Dispersion B-1 (AP-5) | 4.03 |
| | Dispersion C-1 (DPE) | 4.03 |
| | Filler | 1.69 |
| | PVA, Vinol 325, 10% | 7.29 |
| | Zinc Stearate, 23.3% | 1.55 |
| | Water | 9.30 |
| Example-16-1 | Dispersion A-5 (S-205) | 2.12 |
| | Dispersion B-1 (AP-5) | 2.02 |
| | Dispersion B-3 (A-Palm) | 3.53 |
| | Dispersion C-1 (DPE) | 4.03 |
| | Filler | 1.69 |
| | PVA, Vinol 325, 10% | 7.29 |
| | Zinc Stearate, 23.3% | 1.55 |
| | Water | 7.78 |
| Control-17 | Dispersion A-2 (Butyl N-102) | 2.12 |
| | Dispersion B-1 (AP-5) | 4.03 |
| | Dispersion C-1 (DPE) | 4.03 |
| | Filler | 1.69 |
| | PVA, Vinol 325, 10% | 7.29 |
| | Zinc Stearate, 23.3% | 1.55 |
| | Water | 9.30 |
| Example-17-1 | Dispersion A-2 (Butyl N-102) | 2.12 |
| | Dispersion B-1 (AP-5) | 2.02 |
| | Dispersion B-3 (A-Palm) | 3.53 |
| | Dispersion C-1 (DPE) | 4.03 |

-continued

| | Test Formulation Material | Parts |
|---|---|---|
| | Filler | 1.69 |
| | PVA, Vinol 325, 10% | 7.29 |
| | Zinc Stearate, 23.3% | 1.55 |
| | Water | 7.78 |
| Control-18 | Dispersion A-6 (SF-76-296) | 2.82 |
| | Dispersion B-1 (AP-5) | 4.03 |
| | Dispersion C-1 (DPE) | 4.03 |
| | Filler | 1.69 |
| | PVA, Vinol 325, 10% | 7.29 |
| | Zinc Stearate, 23.3% | 1.55 |
| | Water | 8.60 |
| Example-18-1 | Dispersion A-6 (SF-76-296) | 2.82 |
| | Dispersion B-1 (AP-5) | 2.02 |
| | Dispersion B-3 (A-Palm) | 3.53 |
| | Dispersion C-1 (DPE) | 4.03 |
| | Filler | 1.69 |
| | PVA, Vinol 325, 10% | 7.29 |
| | Zinc Stearate, 23.3% | 1.55 |
| | Water | 7.08 |
| Control-19 | Dispersion A-7 (TECVIL) | 1.69 |
| | Dispersion B-1 (AP-5) | 4.03 |
| | Dispersion C-1 (DPE) | 4.03 |
| | Filler | 1.69 |
| | PVA, Vinol 325, 10% | 7.29 |
| | Zinc Stearate, 23.3% | 1.55 |
| | Water | 9.73 |
| Example-19-1 | Dispersion A-7 (TECVIL) | 1.69 |
| | Dispersion B-1 (AP-5) | 2.02 |
| | Dispersion B-3 (A-Palm) | 3.53 |
| | Dispersion C-1 (DPE) | 4.03 |
| | Filler | 1.69 |
| | PVA, Vinol 325, 10% | 7.29 |
| | Zinc Stearate, 23.3% | 1.55 |
| | Water | 8.21 |
| Control-20 | Dispersion A-8 (PB-6) | 2.12 |
| | Dispersion B-1 (AP-5) | 4.03 |
| | Dispersion C-1 (DPE) | 4.03 |
| | Filler | 1.69 |
| | PVA, Vinol 325, 10% | 7.29 |
| | Zinc Stearate, 23.3% | 1.55 |
| | Water | 9.30 |
| Example-20-1 | Dispersion A-8 (PB-6) | 2.12 |
| | Dispersion B-1 (AP-5) | 2.02 |
| | Dispersion B-3 (A-Palm) | 3.53 |
| | Dispersion C-1 (DPE) | 4.03 |
| | Filler | 1.69 |
| | PVA, Vinol 325, 10% | 7.29 |
| | Zinc Stearate, 23.3% | 1.55 |
| | Water | 7.78 |
| Control-21 | Dispersion A-1 (N-102) | 0.37 |
| | Dispersion A-4 (CF-51) | 0.71 |
| | Dispersion B-1 (AP-5) | 2.69 |
| | Dispersion C-1 (DPE) | 2.69 |
| | Filler | 1.12 |
| | PVA, Vinol 325, 10% | 4.87 |
| | Zinc Stearate, 23.3% | 1.03 |
| | Water | 6.52 |
| Example-21-1 | Dispersion A-1 (N-102) | 0.37 |
| | Dispersion A-4 (CF-51) | 0.71 |
| | Dispersion B-1 (AP-5) | 1.35 |
| | Dispersion B-3 (A-Palm) | 2.35 |
| | Dispersion C-1 (DPE) | 2.69 |
| | Filler | 1.12 |
| | PVA, Vinol 325, 10% | 4.87 |
| | Zinc Stearate, 23.3% | 1.03 |
| | Water | 5.51 |
| Control-22 | Dispersion A-1 (N-102) | 0.37 |
| | Dispersion A-5 (S-205) | 0.71 |
| | Dispersion B-1 (AP-5) | 2.69 |
| | Dispersion C-1 (DPE) | 2.69 |
| | Filler | 1.12 |
| | PVA, Vinol 325, 10% | 4.87 |
| | Zinc Stearate, 23.3% | 1.03 |
| | Water | 6.52 |
| Example-22-1 | Dispersion A-1 (N-102) | 0.37 |
| | Dispersion A-5 (S-205) | 0.71 |
| | Dispersion B-1 (AP-5) | 1.35 |
| | Dispersion B-3 (A-Palm) | 2.35 |
| | Dispersion C-1 (DPE) | 2.69 |

-continued

| | Test Formulation Material | Parts |
|---|---|---|
| | Filler | 1.12 |
| | PVA, Vinol 325, 10% | 4.87 |
| | Zinc Stearate, 23.3% | 1.03 |
| | Water | 5.51 |
| Control-23 | Dispersion A-1 (N-102) | 0.37 |
| | Dispersion A-2 (Butyl N-102) | 0.71 |
| | Dispersion B-1 (AP-5) | 2.69 |
| | Dispersion C-1 (DPE) | 2.69 |
| | Filler | 1.12 |
| | PVA, Vinol 325, 10% | 4.87 |
| | Zinc Stearate, 23.3% | 1.03 |
| | Water | 6.52 |
| Example-23-1 | Dispersion A-1 (N-102) | 0.37 |
| | Dispersion A-2 (Butyl N-102) | 0.71 |
| | Dispersion B-1 (AP-5) | 1.35 |
| | Dispersion B-3 (A-Palm) | 2.35 |
| | Dispersion C-1 (DPE) | 2.69 |
| | Filler | 1.12 |
| | PVA, Vinol 325, 10% | 4.87 |
| | Zinc Stearate, 23.3% | 1.03 |
| | Water | 5.51 |
| Control-24 | Dispersion A-1 (N-102) | 0.37 |
| | Dispersion A-6 (SF-76-296) | 0.94 |
| | Dispersion B-1 (AP-5) | 2.69 |
| | Dispersion C-1 (DPE) | 2.69 |
| | Filler | 1.12 |
| | PVA, Vinol 325, 10% | 4.87 |
| | Zinc Stearate, 23.3% | 1.03 |
| | Water | 6.29 |
| Example-24-1 | Dispersion A-1 (N-102) | 0.37 |
| | Dispersion A-6 (SF-76-296) | 0.94 |
| | Dispersion B-1 (AP-5) | 1.35 |
| | Dispersion B-3 (A-Palm) | 2.35 |
| | Dispersion C-1 (DPE) | 2.69 |
| | Filler | 1.12 |
| | PVA, Vinol 325, 10% | 4.87 |
| | Zinc Stearate, 23.3% | 1.03 |
| | Water | 5.28 |
| Control-25 | Dispersion A-1 (N-102) | 0.37 |
| | Dispersion A-7 (TECVIL) | 0.56 |
| | Dispersion B-1 (AP-5) | 2.69 |
| | Dispersion C-1 (DPE) | 2.69 |
| | Filler | 1.12 |
| | PVA, Vinol 325, 10% | 4.87 |
| | Zinc Stearate, 23.3% | 1.03 |
| | Water | 6.67 |
| Example-25-1 | Dispersion A-1 (N-102) | 0.37 |
| | Dispersion A-7 (TECVIL) | 0.56 |
| | Dispersion B-1 (AP-5) | 1.35 |
| | Dispersion B-3 (A-Palm) | 2.35 |
| | Dispersion C-1 (DPE) | 2.69 |
| | Filler | 1.12 |
| | PVA, Vinol 325, 10% | 4.87 |
| | Zinc Stearate, 23.3% | 1.03 |
| | Water | 5.66 |
| Control-26 | Dispersion A-1 (N-102) | 0.37 |
| | Dispersion A-8 (PB-6) | 0.71 |
| | Dispersion B-1 (AP-5) | 2.69 |
| | Dispersion C-1 (DPE) | 2.69 |
| | Filler | 1.12 |
| | PVA, Vinol 325, 10% | 4.87 |
| | Zinc Stearate, 23.3% | 1.03 |
| | Water | 6.52 |
| Example-26-1 | Dispersion A-1 (N-102) | 0.37 |
| | Dispersion A-8 (PB-6) | 0.71 |
| | Dispersion B-1 (AP-5) | 1.35 |
| | Dispersion B-3 (A-Palm) | 2.35 |
| | Dispersion C-1 (DPE) | 2.69 |
| | Filler | 1.12 |
| | PVA, Vinol 325, 10% | 4.87 |
| | Zinc Stearate, 23.3% | 1.03 |
| | Water | 5.51 |
| Control-27 | Dispersion A-1 (N-102) | 0.37 |
| | Dispersion A-3 (PSD-150) | 0.71 |
| | Dispersion B-1 (AP-5) | 2.69 |
| | Dispersion C-1 (DPE) | 2.69 |
| | Filler | 1.12 |
| | PVA, Vinol 325, 10% | 4.87 |
| | Zinc Stearate, 23.3% | 1.03 |

-continued

| Test Formulation | | |
|---|---|---|
| | Material | Parts |
| | Water | 6.52 |
| Example-27 | Dispersion A-1 (N-102) | 0.37 |
| | Dispersion A-3 (PSD-150) | 0.71 |
| | Dispersion B-1 (AP-5) | 1.35 |
| | Dispersion B-3 (A-Palm) | 2.35 |
| | Dispersion C-1 (DPE) | 2.69 |
| | Filler | 1.12 |
| | PVA, Vinol 325, 10% | 4.87 |
| | Zinc Stearate, 23.3% | 1.03 |
| | Water | 5.51 |
| Control-28 | Dispersion A-1 (N-102) | 0.37 |
| | Dispersion A-9 (TH-107) | 0.71 |
| | Dispersion B-1 (AP-5) | 2.69 |
| | Dispersion C-1 (DPE) | 2.69 |
| | Filler | 1.12 |
| | PVA, Vinol 325, 10% | 4.87 |
| | Zinc Stearate, 23.3% | 1.03 |
| | Water | 6.52 |
| Example-28 | Dispersion A-1 (N-102) | 0.37 |
| | Dispersion A-9 (TH-107) | 0.71 |
| | Dispersion B-1 (AP-5) | 1.35 |

-continued

| Test Formulation | | |
|---|---|---|
| | Material | Parts |
| | Dispersion B-3 (A-Palm) | 2.35 |
| | Dispersion C-1 (DPE) | 2.69 |
| | Filler | 1.12 |
| | PVA, Vinol 325, 10% | 4.87 |
| | Zinc Stearate, 23.3% | 1.03 |
| | Water | 5.51 |
| Control-29 | Dispersion A-1 (N-102) | 0.75 |
| | Dispersion B-13 (D-8) | 4.71 |
| | Dispersion C-1 (DPE) | 2.69 |
| | Filler | 1.12 |
| | PVA, Vinol 325, 10% | 4.87 |
| | Zinc Stearate, 23.3% | 1.03 |
| | Water | 4.83 |
| Control-29-1 | Dispersion A-1 (N-102) | 0.75 |
| | Dispersion B-13 (D-8) | 2.35 |
| | Dispersion B-3 (A-Palm) | 2.35 |
| | Dispersion C-1 (DPE) | 2.69 |
| | Filler | 1.12 |
| | PVA, Vinol 325, 10% | 4.87 |
| | Zinc Stearate, 23.3% | 1.03 |
| | Water | 4.84 |

TABLE 1

| | Thermal Response Dynamic Tester - 0.85 Watt/Dot | | | | | | | | | | |
|---|---|---|---|---|---|---|---|---|---|---|---|
| | Pulse (ms)/Macbeth Reading | | | | | | | | | | |
| | 0.5 | 0.7 | 0.9 | 1.1 | 1.3 | 1.5 | 1.7 | 1.9 | 2.1 | 2.3 | 2.5 |
| Control-1 | 0.04 | 0.08 | 0.16 | 0.27 | 0.47 | 0.64 | 0.88 | 1.08 | 1.16 | 1.26 | 1.29 |
| Example-1-1 | 0.09 | 0.22 | 0.44 | 0.66 | 0.88 | 1.06 | 1.22 | 1.26 | 1.32 | 1.35 | 1.36 |
| Example-1-2 | 0.11 | 0.24 | 0.44 | 0.58 | 0.92 | 1.10 | 1.24 | 1.31 | 1.35 | 1.37 | 1.38 |
| Example-1-3 | 0.07 | 0.15 | 0.31 | 0.52 | 0.65 | 0.70 | 0.87 | 1.07 | 1.08 | 1.18 | 1.21 |
| Example-1-4 | 0.11 | 0.19 | 0.29 | 0.40 | 0.52 | 0.63 | 0.73 | 0.93 | 1.25 | 1.30 | 1.33 |
| Example-1-5 | 0.11 | 0.25 | 0.44 | 0.65 | 0.86 | 1.05 | 1.15 | 1.23 | 1.26 | 1.30 | 1.32 |
| Example-1-6 | 0.12 | 0.25 | 0.42 | 0.66 | 0.87 | 1.09 | 1.22 | 1.31 | 1.33 | 1.36 | 1.35 |
| Example-1-7 | 0.16 | 0.26 | 0.44 | 0.64 | 0.85 | 1.07 | 1.19 | 1.28 | 1.32 | 1.34 | 1.38 |
| Example-1-8 | 0.13 | 0.22 | 0.35 | 0.59 | 0.77 | 0.99 | 1.15 | 1.23 | 1.31 | 1.33 | 1.35 |
| Example-1-9 | 0.23 | 0.37 | 0.52 | 0.70 | 0.88 | 1.03 | 1.13 | 1.26 | 1.31 | 1.34 | 1.36 |
| Example-1-10 | 0.19 | 0.27 | 0.43 | 0.59 | 0.76 | 0.95 | 1.16 | 1.22 | 1.27 | 1.32 | 1.32 |
| Example-1-11 | 0.12 | 0.25 | 0.42 | 0.69 | 0.93 | 1.16 | 1.24 | 1.28 | 1.30 | 1.31 | 1.30 |
| Control-2 | 0.15 | 0.34 | 0.62 | 0.95 | 1.20 | 1.28 | 1.33 | 1.35 | 1.35 | 1.39 | 1.38 |
| Example-2-1 | 0.29 | 0.58 | 0.93 | 1.14 | 1.22 | 1.28 | 1.28 | 1.29 | 1.31 | 1.33 | 1.31 |
| Example-2-2 | 0.24 | 0.50 | 0.87 | 1.13 | 1.22 | 1.28 | 1.30 | 1.32 | 1.32 | 1.33 | 1.33 |
| Example-2-3 | 0.14 | 0.31 | 0.59 | 0.81 | 1.09 | 1.17 | 1.20 | 1.24 | 1.25 | 1.27 | 1.26 |
| Example-2-4 | 0.21 | 0.42 | 0.75 | 1.02 | 1.19 | 1.23 | 1.28 | 1.31 | 1.33 | 1.35 | 1.34 |
| Example-2-5 | 0.18 | 0.36 | 0.66 | 0.93 | 1.11 | 1.16 | 1.20 | 1.24 | 1.25 | 1.26 | 1.28 |
| Example-2-6 | 0.23 | 0.45 | 0.80 | 1.07 | 1.21 | 1.27 | 1.27 | 1.31 | 1.32 | 1.32 | 1.34 |
| Example-2-7 | 0.17 | 0.35 | 0.62 | 0.85 | 1.02 | 1.08 | 1.14 | 1.19 | 1.17 | 1.17 | 1.16 |
| Example-2-8 | 0.21 | 0.44 | 0.75 | 1.05 | 1.22 | 1.29 | 1.31 | 1.33 | 1.33 | 1.33 | 1.34 |
| Example-2-9 | 0.21 | 0.38 | 0.67 | 0.88 | 1.07 | 1.15 | 1.15 | 1.19 | 1.19 | 1.21 | 1.21 |
| Example-2-10 | 0.23 | 0.43 | 0.72 | 1.03 | 1.20 | 1.26 | 1.26 | 1.30 | 1.30 | 1.31 | 1.28 |
| Example-2-11 | 0.32 | 0.63 | 1.00 | 1.26 | 1.33 | 1.34 | 1.35 | 1.35 | 1.36 | 1.36 | 1.37 |
| Example-2-12 | 0.31 | 0.61 | 0.99 | 1.26 | 1.32 | 1.36 | 1.35 | 1.37 | 1.37 | 1.37 | 1.37 |
| Control-3 | 0.12 | 0.29 | 0.56 | 0.81 | 1.05 | 1.21 | 1.30 | 1.36 | 1.36 | 1.36 | 1.38 |
| Example-3-1 | 0.10 | 0.28 | 0.48 | 0.68 | 0.83 | 0.94 | 1.03 | 1.09 | 1.12 | 1.14 | 1.17 |
| Example-3-2 | 0.14 | 0.31 | 0.55 | 0.82 | 1.04 | 1.22 | 1.29 | 1.35 | 1.36 | 1.40 | 1.40 |
| Control-4 | 0.27 | 0.58 | 0.97 | 1.17 | 1.25 | 1.30 | 1.31 | 1.31 | 1.33 | 1.33 | 1.33 |
| Example-4-1 | 0.26 | 0.50 | 0.87 | 1.12 | 1.25 | 1.29 | 1.30 | 1.31 | 1.32 | 1.33 | 1.35 |
| Control-5 | 0.32 | 0.66 | 1.01 | 1.23 | 1.31 | 1.34 | 1.35 | 1.35 | 1.35 | 1.36 | 1.36 |
| Example-5-1 | 0.31 | 0.61 | 0.96 | 1.15 | 1.22 | 1.28 | 1.30 | 1.32 | 1.31 | 1.33 | 1.34 |
| Control-6 | 0.15 | 0.36 | 0.61 | 0.90 | 1.12 | 1.21 | 1.31 | 1.32 | 1.31 | 1.34 | 1.33 |
| Example-6-1 | 0.17 | 0.35 | 0.64 | 0.95 | 1.14 | 1.23 | 1.30 | 1.34 | 1.35 | 1.37 | 1.38 |
| Control-7 | 0.25 | 0.53 | 0.92 | 1.15 | 1.32 | 1.35 | 1.36 | 1.35 | 1.37 | 1.38 | 1.39 |
| Example-7-1 | 0.25 | 0.53 | 0.92 | 1.17 | 1.27 | 1.35 | 1.35 | 1.38 | 1.38 | 1.40 | 1.41 |
| Control-8 | 0.20 | 0.45 | 0.74 | 1.03 | 1.14 | 1.28 | 1.31 | 1.32 | 1.32 | 1.34 | 1.35 |
| Example-8-1 | 0.20 | 0.40 | 0.69 | 0.95 | 1.11 | 1.18 | 1.24 | 1.27 | 1.27 | 1.29 | 1.30 |
| Control-9 | 0.21 | 0.47 | 0.80 | 1.05 | 1.26 | 1.30 | 1.33 | 1.34 | 1.35 | 1.33 | 1.35 |
| Example-9-1 | 0.19 | 0.43 | 0.72 | 1.04 | 1.19 | 1.28 | 1.31 | 1.34 | 1.37 | 1.37 | 1.38 |
| Control-10 | 0.15 | 0.31 | 0.51 | 0.82 | 1.00 | 1.05 | 1.13 | 1.14 | 1.19 | 1.23 | 1.21 |
| Example-10-1 | 0.24 | 0.46 | 0.82 | 1.08 | 1.23 | 1.29 | 1.33 | 1.33 | 1.36 | 1.37 | 1.37 |
| Example-10-2 | 0.21 | 0.42 | 0.74 | 1.01 | 1.14 | 1.23 | 1.25 | 1.29 | 1.29 | 1.30 | 1.31 |
| Control-11 | 0.15 | 0.34 | 0.64 | 0.88 | 1.13 | 1.23 | 1.26 | 1.26 | 1.27 | 1.28 | 1.28 |
| Example-11-1 | 0.30 | 0.60 | 0.92 | 1.10 | 1.17 | 1.23 | 1.25 | 1.28 | 1.27 | 1.28 | 1.32 |
| Example-11-2 | 0.24 | 0.52 | 0.82 | 1.07 | 1.17 | 1.23 | 1.25 | 1.26 | 1.26 | 1.28 | 1.28 |
| Control-12 | 0.11 | 0.27 | 0.47 | 0.72 | 0.95 | 1.10 | 1.20 | 1.22 | 1.26 | 1.26 | 1.27 |
| Example-12-1 | 0.19 | 0.39 | 0.69 | 0.94 | 1.13 | 1.21 | 1.27 | 1.27 | 1.30 | 1.32 | 1.35 |
| Example-12-2 | 0.18 | 0.37 | 0.65 | 0.97 | 1.12 | 1.27 | 1.30 | 1.32 | 1.33 | 1.35 | 1.35 |
| Control 13 | 0.18 | 0.38 | 0.61 | 0.88 | 1.04 | 1.17 | 1.24 | 1.28 | 1.29 | 1.29 | 1.31 |
| Example-13-1 | 0.18 | 0.36 | 0.67 | 0.93 | 1.09 | 1.19 | 1.24 | 1.25 | 1.26 | 1.28 | 1.29 |

TABLE 1-continued

| | Thermal Response Dynamic Tester - 0.85 Watt/Dot | | | | | | | | | | |
|---|---|---|---|---|---|---|---|---|---|---|---|
| | Pulse (ms)/Macbeth Reading | | | | | | | | | | |
| | 0.5 | 0.7 | 0.9 | 1.1 | 1.3 | 1.5 | 1.7 | 1.9 | 2.1 | 2.3 | 2.5 |
| Control 14 | 0.19 | 0.39 | 0.70 | 0.95 | 1.10 | 1.20 | 1.23 | 1.25 | 1.25 | 1.25 | 1.26 |
| Example-14-1 | 0.20 | 0.42 | 0.73 | 1.01 | 1.13 | 1.22 | 1.23 | 1.26 | 1.25 | 1.28 | 1.28 |
| Control-15 | 0.14 | 0.33 | 0.59 | 0.90 | 1.10 | 1.24 | 1.29 | 1.31 | 1.32 | 1.31 | 1.33 |
| Example-15-1 | 0.15 | 0.33 | 0.67 | 0.97 | 1.18 | 1.27 | 1.32 | 1.32 | 1.32 | 1.33 | 1.35 |
| Control-16 | 0.15 | 0.32 | 0.55 | 0.80 | 1.02 | 1.13 | 1.19 | 1.26 | 1.26 | 1.29 | 1.31 |
| Example-16-1 | 0.16 | 0.34 | 0.61 | 0.90 | 1.09 | 1.19 | 1.27 | 1.29 | 1.33 | 1.34 | 1.36 |
| Control-17 | 0.15 | 0.32 | 0.59 | 0.82 | 1.02 | 1.15 | 1.21 | 1.25 | 1.27 | 1.28 | 1.27 |
| Example-17-1 | 0.15 | 0.34 | 0.61 | 0.87 | 1.09 | 1.16 | 1.21 | 1.26 | 1.28 | 1.29 | 1.29 |
| Control-18 | 0.12 | 0.28 | 0.52 | 0.82 | 1.00 | 1.15 | 1.28 | 1.36 | 1.38 | 1.38 | 1.41 |
| Example-18-1 | 0.14 | 0.30 | 0.56 | 0.90 | 1.08 | 1.25 | 1.33 | 1.35 | 1.37 | 1.38 | 1.39 |
| Control-19 | 0.27 | 0.52 | 0.91 | 1.21 | 1.32 | 1.36 | 1.36 | 1.37 | 1.37 | 1.38 | 1.37 |
| Example-19-1 | 0.21 | 0.43 | 0.73 | 1.03 | 1.15 | 1.19 | 1.23 | 1.23 | 1.23 | 1.25 | 1.26 |
| Control-20 | 0.26 | 0.50 | 0.89 | 1.20 | 1.31 | 1.39 | 1.38 | 1.41 | 1.40 | 1.41 | 1.39 |
| Example-20-1 | 0.26 | 0.55 | 0.95 | 1.19 | 1.26 | 1.31 | 1.35 | 1.35 | 1.36 | 1.38 | 1.38 |
| Control-21 | 0.19 | 0.37 | 0.68 | 1.05 | 1.23 | 1.28 | 1.34 | 1.36 | 1.37 | 1.37 | 1.37 |
| Example-21-1 | 0.19 | 0.41 | 0.72 | 1.02 | 1.20 | 1.27 | 1.32 | 1.34 | 1.36 | 1.37 | 1.38 |
| Control-22 | 0.20 | 0.37 | 0.70 | 1.00 | 1.14 | 1.23 | 1.27 | 1.30 | 1.30 | 1.33 | 1.32 |
| Example-22-1 | 0.19 | 0.46 | 0.71 | 1.04 | 1.16 | 1.26 | 1.29 | 1.31 | 1.33 | 1.33 | 1.33 |
| Control-23 | 0.20 | 0.39 | 0.72 | 1.01 | 1.15 | 1.23 | 1.28 | 1.30 | 1.32 | 1.32 | 1.31 |
| Example-23-1 | 0.20 | 0.43 | 0.73 | 1.05 | 1.22 | 1.28 | 1.34 | 1.35 | 1.35 | 1.35 | 1.35 |
| Control-24 | 0.18 | 0.39 | 0.67 | 0.98 | 1.19 | 1.28 | 1.32 | 1.35 | 1.36 | 1.36 | 1.37 |
| Example-24-1 | 0.20 | 0.42 | 0.72 | 1.09 | 1.27 | 1.35 | 1.38 | 1.39 | 1.40 | 1.42 | 1.42 |
| Control-25 | 0.22 | 0.49 | 0.86 | 1.16 | 1.31 | 1.36 | 1.38 | 1.39 | 1.38 | 1.38 | 1.37 |
| Example-25-1 | 0.23 | 0.48 | 0.77 | 1.10 | 1.22 | 1.28 | 1.29 | 1.31 | 1.31 | 1.31 | 1.32 |
| Control-26 | 0.27 | 0.50 | 0.87 | 1.20 | 1.31 | 1.34 | 1.36 | 1.37 | 1.40 | 1.39 | 1.39 |
| Example-26-1 | 0.30 | 0.60 | 0.97 | 1.19 | 1.29 | 1.33 | 1.37 | 1.37 | 1.38 | 1.38 | 1.39 |
| Control 27 | 0.22 | 0.45 | 0.78 | 1.05 | 1.17 | 1.26 | 1.27 | 1.30 | 1.29 | 1.32 | 1.32 |
| Example-27-1 | 0.22 | 0.48 | 0.80 | 1.07 | 1.20 | 1.25 | 1.27 | 1.29 | 1.30 | 1.30 | 1.30 |
| Control 28 | 0.19 | 0.41 | 0.76 | 1.00 | 1.18 | 1.27 | 1.28 | 1.27 | 1.29 | 1.30 | 1.29 |
| Example-28-1 | 0.24 | 0.53 | 0.85 | 1.11 | 1.24 | 1.29 | 1.30 | 1.31 | 1.32 | 1.31 | 1.31 |
| Control 29 | 0.27 | 0.47 | 0.78 | 1.08 | 1.20 | 1.24 | 1.25 | 1.27 | 1.29 | 1.29 | 1.29 |
| Example 29-1 | 0.26 | 0.53 | 0.86 | 1.13 | 1.22 | 1.24 | 1.27 | 1.29 | 1.28 | 1.29 | 1.31 |
| 2-layer (A-Palm top) | 0.31 | 0.61 | 0.97 | 1.21 | 1.29 | 1.32 | 1.33 | 1.34 | 1.35 | 1.36 | 1.36 |
| 2-layer (AP-5 top) | 0.34 | 0.62 | 1.07 | 1.23 | 1.27 | 1.36 | 1.36 | 1.38 | 1.38 | 1.40 | 1.40 |

TABLE 2

Thermal Response Facsimile

Key: H = HI-FAX 700
S = SHARP FO-210
C = CANON FAX-230

| Sample | Fax Key | Average Image Intensity Macbeth Reading |
|---|---|---|
| Control-1 | H | 0.76 |
| Example-1-1 | H | 1.08 |
| Example-1-2 | H | 1.07 |
| Example-1-3 | S | 1.13 |
| Example-1-4 | S | 1.17 |
| Example-1-5 | S | 1.24 |
| Example-1-6 | S | 1.30 |
| Example-1-7 | C | 1.17 |
| Example-1-8 | C | 1.22 |
| Example-1-9 | C | 1.24 |
| Example-1-10 | C | 1.25 |
| Example-1-11 | C | 1.35 |
| Control-2 | H | 1.26 |
| Example-2-1 | H | 1.29 |
| Example-2-2 | H | 1.32 |
| Example-2-3 | S | 1.03 |
| Example-2-4 | S | 1.00 |
| Example-2-5 | S | 0.96 |
| Example-2-6 | S | 1.00 |
| Example-2-7 | C | 1.25 |
| Example-2-8 | C | 1.35 |
| Example-2-9 | C | 1.18 |
| Example-2-10 | C | 1.34 |
| Example-2-11 | C | 1.35 |
| Example-2-12 | C | 1.39 |
| Control-3 | H | 1.20 |
| Example-3-1 | H | 0.92 |
| Example-3-2 | H | 1.32 |
| Control-4 | H | 1.36 |
| Example-4-1 | H | 1.31 |
| Control-5 | H | 1.35 |
| Example-5-1 | H | 1.27 |
| Control-6 | H | 1.30 |

TABLE 2-continued

Thermal Response Facsimile

Key: H = HI-FAX 700
S = SHARP FO-210
C = CANON FAX-230

| Sample | Fax Key | Average Image Intensity Macbeth Reading |
|---|---|---|
| Example-6-1 | H | 1.33 |
| Control-7 | H | 1.34 |
| Example-7-1 | H | 1.30 |
| Control-8 | S | 1.00 |
| Example-8-1 | S | 1.02 |
| Control-9 | S | 1.10 |
| Example-9-1 | S | 1.11 |
| Control-10 | H | 1.25 |
| Example-10-1 | H | 1.31 |
| Example-10-2 | H | 1.34 |
| Control-11 | H | 1.32 |
| Example-11-1 | H | 1.24 |
| Example-11-2 | H | 1.32 |
| Control-12 | H | 1.25 |
| Example-12-1 | H | 1.27 |
| Example-12-2 | H | 1.33 |
| Control 13 | S | 0.86 |
| Example-13-1 | S | 0.89 |
| Control 14 | S | 0.88 |
| Example-14-1 | S | 0.95 |
| Control-15 | C | 1.33 |
| Example-15-1 | C | 1.40 |
| Control-16 | C | 1.30 |
| Example-16-1 | C | 1.33 |
| Control-17 | C | 1.32 |
| Example-17-1 | C | 1.28 |
| Control-18 | C | 1.33 |
| Example-18-1 | C | 1.33 |
| Control-19 | C | 1.38 |
| Example-19-1 | C | 1.26 |
| Control-20 | C | 1.39 |
| Example-20-1 | C | 1.39 |
| Control-21 | C | 1.34 |

TABLE 2-continued

Thermal Response Facsimile

Key: H = HI-FAX 700
S = SHARP FO-210
C = CANON FAX-230

| Sample | Fax Key | Average Image Intensity Macbeth Reading |
|---|---|---|
| Example-21-1 | C | 1.38 |
| Control-22 | C | 1.32 |
| Example-22-1 | C | 1.33 |
| Control-23 | C | 1.31 |
| Example-23-1 | C | 1.29 |
| Control-24 | C | 1.36 |
| Example-24-1 | C | 1.37 |
| Control-25 | C | 1.42 |
| Example-25-1 | C | 1.35 |
| Control-26 | C | 1.42 |

TABLE 2-continued

Thermal Response Facsimile

Key: H = HI-FAX 700
S = SHARP FO-210
C = CANON FAX-230

| Sample | Fax Key | Average Image Intensity Macbeth Reading |
|---|---|---|
| Example-26-1 | C | 1.40 |
| Control 27 | S | 1.02 |
| Example-27-1 | S | 1.07 |
| Control 28 | S | 1.05 |
| Example-28-1 | S | 1.06 |
| Control 29 | C | 1.32 |
| Example 29-1 | C | 1.31 |
| 2-layer (A-Palm top) | C | 1.36 |
| 2-layer (AP-5 top) | C | 1.38 |

TABLE 3

Image Stability to Oils, Solvents, and Plasticizer Oil/Result

| | Crisco Time | | IP Time | | Skin Time | | PVC Film Time | |
|---|---|---|---|---|---|---|---|---|
| Sample | 1 Day | (Days) | 1 Day | (Days) | 1 Day | (Days) | 1 Day | (Days) |
| Control-1 | 4 | 4(4) | 2 | 4(4) | 3 | 4(4) | 2 | 3(2) |
| Example-1-1 | 1 | 2(7) | 0 | 1(7) | 1 | 3(7) | 1 | 3(2) |
| Example-1-2 | 2 | 2(8) | 0 | 0(8) | 0 | 1(5) | 3 | 4(2) |
| Example-1-3 | 1 | 1(7) | 0 | 0(7) | 0 | 1(7) | 0 | 0(2) |
| Example-1-4 | 3 | 3(7) | 0 | 3(7) | 0 | 4(7) | 4 | 4(2) |
| Example-1-5 | 4 | 4(7) | 4 | 4(7) | 1 | 4(7) | 1 | 1(2) |
| Example-1-6 | 4 | 4(7) | 0 | 1(7) | 1 | 2(7) | 3 | 4(2) |
| Example-1-7 | 0 | 2(7) | 0 | 2(7) | 0 | 2(7) | 0 | 3(2) |
| Example-1-8 | 0 | 2(7) | 0 | 1(7) | 0 | 0(7) | 0 | 3(2) |
| Example-1-9 | 0 | 2(7) | 0 | 2(7)- | 0 | 3(7) | 0 | 2(2) |
| Example-1-10 | 1 | 3(7) | 0 | 1(7) | 0 | 0(7) | 0 | 3(2) |
| Example-1-11 | 4 | 4(8) | 0 | 0(8) | 0 | 2(8) | 3 | 4(2) |
| Control-2 | 4 | 4(5) | 4 | 4(5) | 3 | 4(5) | 3 | 4(2) |
| Example-2-1 | 2 | 3(8) | 2 | 3(8) | 3 | 4(8) | 1 | 2(2) |
| Example-2-2 | 2 | 3(5) | 0 | 0(5) | 2 | 3(5) | 2 | 2(2) |
| Example-2-3 | 1 | 2(6) | 0 | 2(6) | 1 | 3(6) | 1 | 1(2) |
| Example-2-4 | 3 | 4(6) | 0 | 2(6) | 3 | 4(6) | 2 | 3(2) |
| Example-2-5 | 1 | 4(6) | 0 | 3(6) | 2 | 4(6) | 2 | 2(2) |
| Example-2-6 | 4 | 4(6) | 0 | 2(6) | 3 | 3(6) | 2 | 2(2) |
| Example-2-7 | 4 | 4(6) | 4 | 4(6) | 4 | 4(6) | 2 | 2(2) |
| Example-2-8 | 4 | 4(6) | 0 | 1(6) | 1 | 2(6) | 3 | 4(2) |
| Example-2-9 | 4 | 4(6) | 4 | 4(6) | 4 | 4(6) | 2 | 2(2) |
| Example-2-10 | 4 | 4(6) | 1 | 2(6) | 2 | 2(6) | 3 | 3(2) |
| Example-2-11 | 4 | 4(8) | 4 | 4(8) | 3 | 4(8) | 2 | 3(2) |
| Example-2-12 | 4 | 4(8) | 0 | 0(8) | 0 | 1(8) | 1 | 3(2) |
| Control-3 | 4 | 4(2) | 4 | 4(2) | 2 | 2(2) | 4 | 4(2) |
| Example-3-1 | 4 | 4(2) | 4 | 4(2) | 4 | 4(2) | 1 | 1(2) |
| Example-3-2 | 4 | 4(2) | 0 | 1(2) | 2 | 2(2) | 3 | 3(2) |
| Control-4 | 4 | 4(2) | 4 | 4(2) | 3 | 4(2) | 3 | 4(2) |
| Example-4-1 | 4 | 4(2) | 0 | 1(2) | 2 | 2(2) | 1 | 2(2) |
| Control-5 | 4 | 4(2) | 0 | 0(2) | 1 | 1(2) | 1 | 1(2) |
| Example-5-1 | 4 | 4(2) | 0 | 0(2) | 1 | 1(2) | 0 | 0(2) |
| Control-6 | 3 | 4(4) | 3 | 4(4) | 4 | 4(4) | 3 | 3(2) |
| Example-6-1 | 1 | 1(4) | 1 | 2(4) | 1 | 2(4) | 2 | 2(4) |
| Control-7 | 4 | 4(6) | 0 | 1(6) | 0 | 1(6) | | 4(2) |
| Example-7-1 | 2 | 3(6) | 0 | 0(6) | 1 | 1(6) | | 1(2) |
| Control-8 | 4 | 4(8) | 0 | 2(8) | 1 | 3(8) | 3 | 4(4) |
| Example-8-1 | 3 | 4(8) | 0 | 0(8) | 0 | 3(8) | 2 | 4(4) |
| Control-9 | 4 | 4(8) | 3 | 4(8) | 2 | 4(8) | 4 | 4(4) |
| Example-9-1 | 3 | 4(8) | 1 | 3(8) | 2 | 4(8) | 2 | 3(4) |
| Control-10 | 4 | 4(8) | 3 | 4(8) | 1 | 2(8) | 2 | 3(2) |
| Example-10-1 | 1 | 1(8) | 1 | 1(8) | 1 | 1(8) | 1 | 1(2) |
| Example-10-2 | 2 | 2(8) | 0 | 0(8) | 1 | 1(8) | 1 | 2(2) |
| Control-11 | 4 | 4(8) | 2 | 4(8) | 0 | 4(8) | 4 | 4(2) |
| Example-11-1 | 2 | 2(8) | 1 | 2(8) | 2 | 3(8) | 2 | 2(8) |
| Example-11-2 | 3 | 3(8) | 0 | 0(8) | 0 | 0(8) | 3 | 3(2) |
| Control-12 | 4 | 4(8) | 3 | 4(8) | 1 | 4(8) | 4 | 4(2) |
| Example-12-1 | 3 | 3(8) | 3 | 3(8) | 1 | 3(8) | 2 | 2(2) |
| Example-12-2 | 4 | 4(8) | 0 | 0(8) | 1 | 1(8) | 3 | 3(2) |
| Control 13 | 4 | 4(6) | 4 | 4(6) | 4 | 4(6) | 3 | 4(2) |
| Example-13-1 | | 4(9) | | 1(9) | | 2(9) | | 3(3) |
| Control-14 | 4 | 4(6) | 4 | 4(6) | 4 | 4(6) | 4 | 4(2) |
| Example-14-1 | | 4(9) | | 4(9) | | 4(9) | | 4(3) |
| Control-15 | 4 | 4(9) | 2 | 4(9) | 1 | 3(9) | 2 | 2(2) |
| Example-15-1 | 4 | 4(9) | 0 | 0(9) | 1 | 2(9) | 1 | 1(2) |
| Control-16 | 4 | 4(9) | 3 | 4(9) | 3 | 4(9) | 0 | 2(2) |
| Example-16-1 | 4 | 4(9) | 0 | 0(9) | 2 | 3(9) | 2 | 2(2) |

TABLE 3-continued

| | Image Stability to Oils, Solvents, and Plasticizer Oil/Result | | | | | | | |
|---|---|---|---|---|---|---|---|---|
| | Crisco Time | | IP Time | | Skin Time | | PVC Film Time | |
| Sample | 1 Day | (Days) | 1 Day | (Days) | 1 Day | (Days) | 1 Day | (Days) |
| Control-17 | 4 | 4(9) | 3 | 4(9) | 2 | 4(9) | 1 | 2(2) |
| Example-17-1 | 4 | 4(9) | 0 | 2(9) | 2 | 3(9) | 2 | 2(2) |
| Control-18 | 4 | 4(9) | 4 | 4(9) | 4 | 4(9) | 2 | 3(2) |
| Example-18-1 | 4 | 4(9) | 4 | 4(9) | 4 | 4(9) | 3 | 3(2) |
| Control-19 | 4 | 4(9) | 3 | 4(9) | 3 | 3(9) | 1 | 2(2) |
| Example-19-1 | 4 | 4(9) | 1 | 4(9) | 1 | 2(9) | 2 | 2(2) |
| Control-20 | 4 | 4(9) | 0 | 0(9) | 1 | 1(9) | 1 | 2(2) |
| Example-20-1 | 4 | 4(9) | 0 | 0(9) | 0 | 2(9) | 3 | 3(2) |
| Control-21 | 4 | 4(9) | 2 | 4(9) | 1 | 2(9) | 2 | 2(2) |
| Example-21-1 | 3 | 4(9) | 0 | 0(9) | 1 | 2(9) | 1 | 1(2) |
| Control-22 | 4 | 4(9) | 3 | 4(9) | 2 | 3(9) | 2 | 2(2) |
| Example-22-1 | 3 | 4(9) | 0 | 1(9) | 1 | 2(9) | 2 | 2(2) |
| Control-23 | 4 | 4(9) | 3 | 4(9) | 2 | 3(9) | 2 | 3(2) |
| Example-23-1 | 4 | 4(9) | 0 | 1(9) | 1 | 1(9) | 1 | 2(2) |
| Control-24 | 4 | 4(9) | 4 | 4(9) | 3 | 3(9) | 2 | 3(2) |
| Example-24-1 | 4 | 4(9) | 1 | 2(9) | 2 | 3(9) | 2 | 3(2) |
| Control-25 | 4 | 4(9) | 4 | 4(9) | 1 | 3(9) | 2 | 2(2) |
| Example-25-1 | 4 | 4(9) | 0 | 1(9) | 1 | 1(9) | 0 | 3(2) |
| Control-26 | 4 | 4(9) | 0 | 0(9) | 1 | 1(9) | 2 | 2(2) |
| Example-26-1 | 4 | 4(9) | 0 | 0(9) | 1 | 1(9) | 1 | 2(2) |
| Control-27 | 4 | 4(6) | 4 | 4(6) | 2 | 2(6) | 2 | 3(2) |
| Example-27-1 | | 4(9) | | 0(9) | | 1(9) | | 2(3) |
| Control-28 | 4 | 4(6) | 4 | 4(6) | 2 | 3(6) | 2 | 4(2) |
| Example-28-1 | | 4(9) | | 1(9) | | 2(9) | | 2(3) |
| Control-29 | 4 | 4(6) | 0 | 2(6) | 0 | 0(6) | 1 | 1(3) |
| Example-29-1 | 4 | 4(6) | 0 | 0(6) | 0 | 0(6) | 1 | 2(2) |
| 2-layer (A-Palm top) | 4 | 4(4) | 0 | 0(4) | 1 | 2(4) | 1 | 2(2) |
| 2-layer (AP-5 top) | 4 | 4(4) | 0 | 0(4) | 0 | 1(4) | 2 | 3(2) |

TABLE 4

| | Image Stability to 90° F./90% Relative Humidity | | |
|---|---|---|---|
| | Intensity | | |
| Sample | Initially | 1 Week | (Weeks)* |
| Control-1 | 1.13 | 0.95 | 0.92(2) |
| Example-1-1 | 0.97 | 0.26 | 0.24(2) |
| Example-1-2 | 1.05 | 0.87 | 0.80(2) |
| Example-1-3 | 1.19 | 0.52 | 0.47(2) |
| Example-1-4 | 1.34 | 1.32 | 1.33(2) |
| Example-1-5 | 1.32 | 0.71 | 0.53(2) |
| Example-1-6 | 1.37 | 1.37 | 1.37(2) |
| Example-1-7 | 1.20 | 0.17 | 0.16(2) |
| Example-1-8 | 1.28 | 1.19 | 1.14(2) |
| Example-1-9 | 1.20 | 0.28 | 0.27(2) |
| Example-1-10 | 1.25 | 1.12 | 1.07(2) |
| Example-1-11 | 1.31 | 1.37 | 1.33(2) |
| Control-2 | 1.27 | 1.10 | 1.03(2) |
| Control-2-1 | 1.21 | 0.35 | 0.30(2) |
| Control-2-2 | 1.30 | 1.29 | 1.25(2) |
| Example-2-3 | 0.92 | 0.25 | 0.21(3) |
| Example-2-4 | 0.98 | 0.78 | 0.55(3) |
| Example-2-5 | 0.86 | 0.27 | 0.13(3) |
| Example-2-6 | 0.97 | 0.69 | 0.41(3) |
| Example-2-7 | 1.10 | 0.30 | 0.25(2) |
| Example-2-8 | 1.35 | 1.31 | 1.27(2) |
| Example-2-9 | 1.11 | 0.41 | 0.34(2) |
| Example-2-10 | 1.34 | 1.31 | 1.28(2) |
| Example-2-11 | 1.32 | 0.72 | 0.61(2) |
| Example-2-12 | 1.37 | 1.35 | 1.34(2) |
| Control-3 | 1.12 | 0.88 | 0.76(2) |
| Example-3-1 | 0.78 | 0.23 | 0.21(2) |
| Example-3-2 | 1.20 | 1.07 | 0.90(2) |
| Control-4 | 1.14 | 1.04 | 0.57(2) |
| Example-4-1 | 1.23 | 1.00 | 0.68(2) |
| Control-5 | 1.27 | 1.27 | 1.23(2) |
| Example-5-1 | 1.23 | 1.25 | 1.24(2) |
| Control-6 | 1.24 | 1.16 | 1.17(2) |
| Example-6-1 | 1.32 | 1.30 | 1.30(2) |
| Control-7 | 1.33 | 1.23 | 1.10(2) |
| Example-7-1 | 1.28 | 1.24 | 1.21(2) |
| Control-8 | 1.00 | 0.79 | 0.67(2) |
| Example-8-1 | 1.03 | 0.90 | 0.80(2) |

TABLE 4-continued

| | Image Stability to 90° F./90% Relative Humidity | | |
|---|---|---|---|
| | Intensity | | |
| Sample | Initially | 1 Week | (Weeks)* |
| Control-9 | 1.03 | 0.65 | 0.44(2) |
| Example-9-1 | 1.06 | 0.88 | 0.78(2) |
| Control-10 | 1.30 | 1.28 | 1.21(2) |
| Example-10-1 | 1.28 | 0.58 | 0.46(2) |
| Example-10-2 | 1.33 | 1.28 | 1.29(2) |
| Control-11 | 1.31 | 1.22 | 1.13(2) |
| Example-11-1 | 1.21 | 0.35 | 0.27(2) |
| Example-11-2 | 1.30 | 1.31 | 1.25(2) |
| Control-12 | 1.20 | 1.06 | 0.93(2) |
| Example-12-1 | 1.21 | 0.43 | 0.36(2) |
| Example-12-2 | 1.26 | 1.25 | 1.24(2) |
| Control-13 | .80 | 0.53 | 0.47(2) |
| Example-13-1 | 0.88 | 0.70 | 0.57(2) |
| Control-14 | 0.87 | 0.14 | 0.06(2) |
| Example-14-1 | 0.84 | 0.30 | 0.16(2) |
| Control-15 | 1.36 | 1.27 | 1.28(2) |
| Example-15-1 | 1.38 | 1.28 | 1.28(2) |
| Control-16 | 1.29 | 1.15 | 1.00(2) |
| Example-16-1 | 1.31 | 1.28 | 1.26(2) |
| Control-17 | 1.29 | 1.20 | 1.11(2) |
| Example-17-1 | 1.30 | 1.23 | 1.23(2) |
| Control-18 | 1.34 | 0.21 | 0.17(2) |
| Example-18-1 | 1.30 | 0.33 | 0.19(2) |
| Control-19 | 1.41 | 1.25 | 1.14(2) |
| Example-19-1 | 1.25 | 1.17 | 1.12(2) |
| Control-20 | 1.42 | 1.38 | 1.37(2) |
| Example-20-1 | 1.42 | 1.34 | 1.35(2) |
| Control-21 | 1.37 | 1.29 | 1.30(2) |
| Example-21-1 | 1.41 | 1.33 | 1.34(2) |
| Control-22 | 1.36 | 1.27 | 1.23(2) |
| Example-22-1 | 1.34 | 1.29 | 1.30(2) |
| Control-23 | 1.34 | 1.24 | 1.20(2) |
| Example-23-1 | 1.34 | 1.26 | 1.26(2) |
| Control-24 | 1.38 | 1.15 | 0.94(2) |
| Example-24-1 | 1.37 | 1.28 | 1.12(2) |
| Control-25 | 1.43 | 1.19 | 1.06(2) |
| Example-25-1 | 1.35 | 1.20 | 1.29(2) |
| Control-26 | 1.42 | 1.39 | 1.40(2) |

TABLE 4-continued

| Image Stability to 90° F./90% Relative Humidity | | | |
|---|---|---|---|
| | Intensity | | |
| Sample | Initially | 1 Week | (Weeks)* |
| Example-26-1 | 1.40 | 1.35 | 1.36(2) |
| Control-27 | 1.02 | 0.93 | 0.87(2) |
| Example-27-1 | 1.02 | 0.93 | 0.87(2) |
| CControl-28 | 1.00 | 0.71 | 0.65(2) |
| Example-28-1 | 0.98 | 0.82 | 0.71(2) |
| Control-29 | 1.29 | 1.31 | 1.28(2) |
| Example-29-1 | 1.26 | 1.23 | 1.22(2) |
| 2-layer(A-Palm top) | 1.37 | 1.33 | 1.33(2) |
| 2-layer(AP-5 top) | 1.37 | 1.35 | 1.36(2) |

*Number of weeks is given in the parenthesis following the Macbeth RD514 densitometer reading.

As shown by Table 3, the record material according to the invention when imaged is considerably more resistant to fade or erasure as compared to record materials not having the combination of the invention.

Tables 1 and 2 confirm that viable and functional heat sensitive record materials ae conistently produced with the compounds of the invention.

Table 3 is a test of the stability of the image intensity when contacted with saponified fat, internal phase solvent (carbonless solvent), skin oil, and plasticizer in PVC film.

Table 4 is a test of the stability of image intensity in a test chamber at 90° F. and 90% humidty. The test chamber used was a constant temperature humidity cabinet manufactured by Blue M Company, Blue Island, Ill.

As can be seen from Tables 3 and 4, the record materials incorporating ascorbic acid esters of the invention are remarkably resistant to fade or erasure from one or more common external challenges including contact with saponified fats (crisco), skin oil, plasticizers, internal phase solvent (carbonless solvents), or high heat and humidity. The ascorbic acid ester—containing record materials in all cases excelled in at least one type of challenge which otherwise would have degraded the image. The ascorbic acid ester—containing record materials always imparted resistance in at least one category even through not consistently the same category.

The principles, preferred embodiments, and modes of operation of the present invention have been described in the foregoing specification. The invention which is intended to be protected herein, however, is not to be construed as limited to the particular forms disclosed, since these are to be regarded as illustrative rather than restrictive. Variations and changes can be made by those skilled in the art without departing from the spirit and scope of the invention.

Obvious and included variations would clearly include for example, rather than applying the components of the colorforming system in one coating, multiple layers can be applied. For example, a layer with modifier and developer can be top coated with a layer containing chromogen, an ascorbic acid ester of the invention and modifier. Another workable variation, equally within the scope of the invention would be to apply to a substrate a coating of ascorbic acid ester and modifier over which is top coated a dispersion of chromogen, developer and modifier. Other such structural variations would be clearly evident to the skilled worker in the art all without departing from the spirit and scope of the invention.

What is claimed is:

1. A thermally-responsive record material comprising a support member bearing a thermally-sensitive colorforming composition comprising a chromogenic material and an acidic developer material in proximate relationship, whereby the melting, softening or sublimation of either material produces a change in color by reaction between the two, and an ascorbic acid ester of the formula

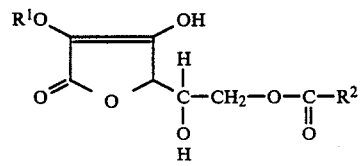

wherein $R^1$ is selected from hydrogen or a straight chain or branched chain acyl group of from 9 to 22 carbons inclusive, wherein $R^2$ is a straight chain or branched chain alkyl group of from 8 to 21 carbons inclusive.

2. The thermally-responsive record material according to claim 1, wherein, in the ascorbic acid ester, $R^1$ is hydrogen.

3. The record material according to claim 1 wherein the ascorbic acid ester is selected from the group consisting of ascorbic acid-6-palmitate, ascorbic acid-6-stearate, ascorbic acid-6-laurate, iso ascorbic acid-6-laurate, and ascorbic acid-2,6-dipalmitate.

4. The record material according to claim 1 wherein the ascorbic acid ester is ascobic acid-6-palmitate.

5. The record material according to claim 1 wherein the ascorbic acid ester is iso ascorbic acid-6-laurate.

6. The record material according to claim 1 wherein the ascorbic acid ester is ascorbic acid-6-stearate.

7. The record material according to claim 1 wherein the ascorbic acid ester is ascorbic acid-2,6-dipalmitate.

8. The record material of claim 1 comprising in addition a binder.

9. The record material of claim 1 in which the acidic developer material is a phenol compound.

10. The record material of claim 9 in which the phenol compound is selected from the group consisting of 4,4'-isopropylindinediphenol, ethyl-4,4-bis(4-hydroxyphenyl)-pentanoate, n-propyl-4,4-bis(4-hydroxyphenyl)pentanoate, isopropyl-4,4-bis(4-hydroxyphenyl)pentanoate, methyl-4,4-bis(4-hydroxyphenyl)-pentanoate, bis(3-allyl-4-hydroxyphenylsulfone), allyl-4,4-bis(hydroxyphenyl)pentanoate, 2,2-bis(4-hydroxyphenyl)-4-methylpentane, p-hydroxybenzophenone, 2,4-dihydroxybenzophenone, 1,1-bis(4-hydroxyphenyl)cyclohexane, 2,2-bis(4-hydroxyphenyl)-5-methylhexane, benzyl-p-hydroxybenzoate, 4-(4-(1-methylethoxy)phenyl)sulphonylphenyl, 4,4'-[1,3-phenylenebis(1-methylethylene]bisphenol, and mixtures thereof.

11. The record material of claim 9 in which the phenol compound is 2,2-bis(4-hydroxyphenyl)-4-methylpentane.

12. The record material of claim 9 in which the phenol compound is benzyl-p-hydroxybenzoate.

13. The record material of claim 9 in which the phenol compound is 4,4'-isopropylidinediphenol.

14. The record material of claim 1 in which the chromogenic material is selected from the group consisting of 3-diethylamino-6-methyl-7-anilinofluoran; 7-(1-ethyl- 2-methylindol-3-yl)-7-(4-diethylamino-2-ethoxyphenyl)-5,7-dihydrofuro[3,4-b]pyridin-5-one; 3-diethylamino-7-(2-chloroanilino)fluoran; 3-(N-methylcyclohexylamino)-6-methyl-7-anilinofluoran; 7-(1-octyl-2-methylindol-3-yl)-7-(4-diethylamino-2-ethoxyphenyl)-5,7-dihydrofuro[3,4-b]pyridin-5-one; 3'-phenyl-7-dibenzylamino-2,2'-spiro-di-[2H-1-benzopyran]; 3-dibutylamino-6-methyl-7-anilinofluoran; 3-(N-ethyl-N-tetrahydrofurfurylamino)-6-methyl-7-anilinofluoran; 3-dibutylamino-7-(2-chloroanilino)fluoran; 3,3-bis(4-dimethylaminophenyl)-6-dimethylaminophthalide; 7-(1-ethyl-2-methylindol-3-yl)-7-(4-diethylamino-2-ethoxyphenyl)-5,7-dihydrofuro,[3,4-b]pyridine-5-one; 3,5',6-tris(dimethylamino)spiro[9H-fluorene-9,1'(3'H)-isobenzofuran]3'-one, and mixtures thereof.

15. The record material of claim 1 comprising in addition a modifier.

16. The record material of claim 15 wherein the modifier is selected from 1,2-diphenoxyethane, stearamide, acetoacet-o-toluidine, p-benzylbiphenyl, and phenyl-1-hydroxy-2-naphthoate.

* * * * *